US011641996B2

(12) United States Patent
Johnson et al.

(10) Patent No.: US 11,641,996 B2
(45) Date of Patent: May 9, 2023

(54) ROBOTIC CLEANER

(71) Applicant: BISSELL Homecare, Inc., Grand Rapids, MI (US)

(72) Inventors: Steve M. Johnson, Hudsonville, MI (US); Todd Vantongeren, Ada, MI (US)

(73) Assignee: BISSELL Inc., Grand Rapids, MI (US)

( * ) Notice: Subject to any disclaimer, the term of this patent is extended or adjusted under 35 U.S.C. 154(b) by 19 days.

(21) Appl. No.: 17/540,355

(22) Filed: Dec. 2, 2021

(65) Prior Publication Data

US 2022/0087497 A1 Mar. 24, 2022

Related U.S. Application Data

(63) Continuation of application No. 16/438,552, filed on Jun. 12, 2019, now Pat. No. 11,219,347, which is a continuation-in-part of application No. 16/217,748, filed on Dec. 12, 2018, now Pat. No. 11,317,779.

(60) Provisional application No. 62/609,449, filed on Dec. 22, 2017.

(51) Int. Cl.

| | |
|---|---|
| ***A47L 11/30*** | (2006.01) |
| ***A47L 11/24*** | (2006.01) |
| ***A47L 11/40*** | (2006.01) |

(52) U.S. Cl.

CPC ..... *A47L 11/305* (2013.01); *A47L 11/24* (2013.01); *A47L 11/4083* (2013.01); *A47L 2201/02* (2013.01); *A47L 2201/04* (2013.01); *G05D 2201/0203* (2013.01)

(58) Field of Classification Search

CPC .... A47L 11/305; A47L 11/24; A47L 11/4083; A47L 2201/02; A47L 2201/04; G05D 2201/0203

See application file for complete search history.

(56) References Cited

U.S. PATENT DOCUMENTS

| | | | |
|---|---|---|---|
| 5,815,880 | A | 10/1998 | Nakanishi |
| 5,894,621 | A | 4/1999 | Kubo |
| 7,320,149 | B1 | 1/2008 | Huffman et al. |
| 8,065,778 | B2 | 11/2011 | Kim et al. |
| 8,438,695 | B2 | 5/2013 | Gilbert, Jr. et al. |
| 9,282,867 | B2 | 3/2016 | Williams et al. |
| 9,844,311 | B2 | 12/2017 | Zhang |
| 2005/0229340 | A1 | 10/2005 | Sawalski et al. |
| 2006/0185690 | A1 | 8/2006 | Song et al. |
| 2012/0260948 | A1 | 10/2012 | Balas et al. |
| 2014/0182627 | A1 | 7/2014 | Williams et al. |

FOREIGN PATENT DOCUMENTS

| | | | |
|---|---|---|---|
| CN | 204120958 | U | 1/2015 |
| CN | 107224251 | A | 10/2017 |
| CN | 108042060 | A | 5/2018 |
| EP | 3031376 | A1 | 6/2016 |
| GB | 2502131 | A | 11/2013 |
| WO | 2017037669 | A2 | 3/2017 |
| WO | 2017037673 | A1 | 3/2017 |

*Primary Examiner* — David Redding

(74) *Attorney, Agent, or Firm* — Warner Norcross + Judd LLP

(57) ABSTRACT

An autonomous floor cleaner or floor cleaning robot can include an autonomously moveable housing and a drive system for autonomously moving the autonomously moveable housing over a surface to be cleaned based on inputs from a controller. A brush chamber and a debris receptacle can be formed as a unitary assembly removable from the autonomously moveable housing.

20 Claims, 23 Drawing Sheets

ROBOTIC CLEANER

CROSS-REFERENCE TO RELATED APPLICATION(S)

This application is a continuation of U.S. patent application Ser. No. 16/438,552, filed Jun. 12, 2019, which is a continuation-in-part of U.S. patent application Ser. No. 16/217,748, filed Dec. 12, 2018, which claims the benefit of U.S. Provisional Patent Application No. 62/609,449 filed Dec. 22, 2017, all of which are incorporated herein by reference in their entirety.

BACKGROUND

Autonomous or robotic floor cleaners can move without the assistance of a user or operator to clean a floor surface. For example, the floor cleaner can be configured to sweep dirt (including dust, hair, and other debris) into a collection bin carried on the floor cleaner or to sweep dirt using a cloth which collects the dirt. The floor cleaner can move randomly about a surface while cleaning the floor surface or use a mapping/navigation system for guided navigation about the surface. Some floor cleaners are further configured to apply and extract liquid for deep cleaning carpets, rugs, and other floor surfaces.

BRIEF SUMMARY

In one aspect, the disclosure relates to a floor cleaning robot. The floor cleaning robot includes an autonomously moveable housing, and a unitary assembly removably mounted to the autonomously moveable housing, the unitary assembly including a brush chamber and a debris receptacle. The floor cleaning robot also includes a brushroll located in the brush chamber, a supply tank, and at least one fluid distributor in fluid communication with the supply tank.

DETAILED DESCRIPTION

The disclosure generally relates to autonomous floor cleaners for cleaning floor surfaces, including hardwood, tile and stone. More specifically, the disclosure relates to devices, systems and methods for sweeping and mopping with an autonomous floor cleaner.

Figure 1:
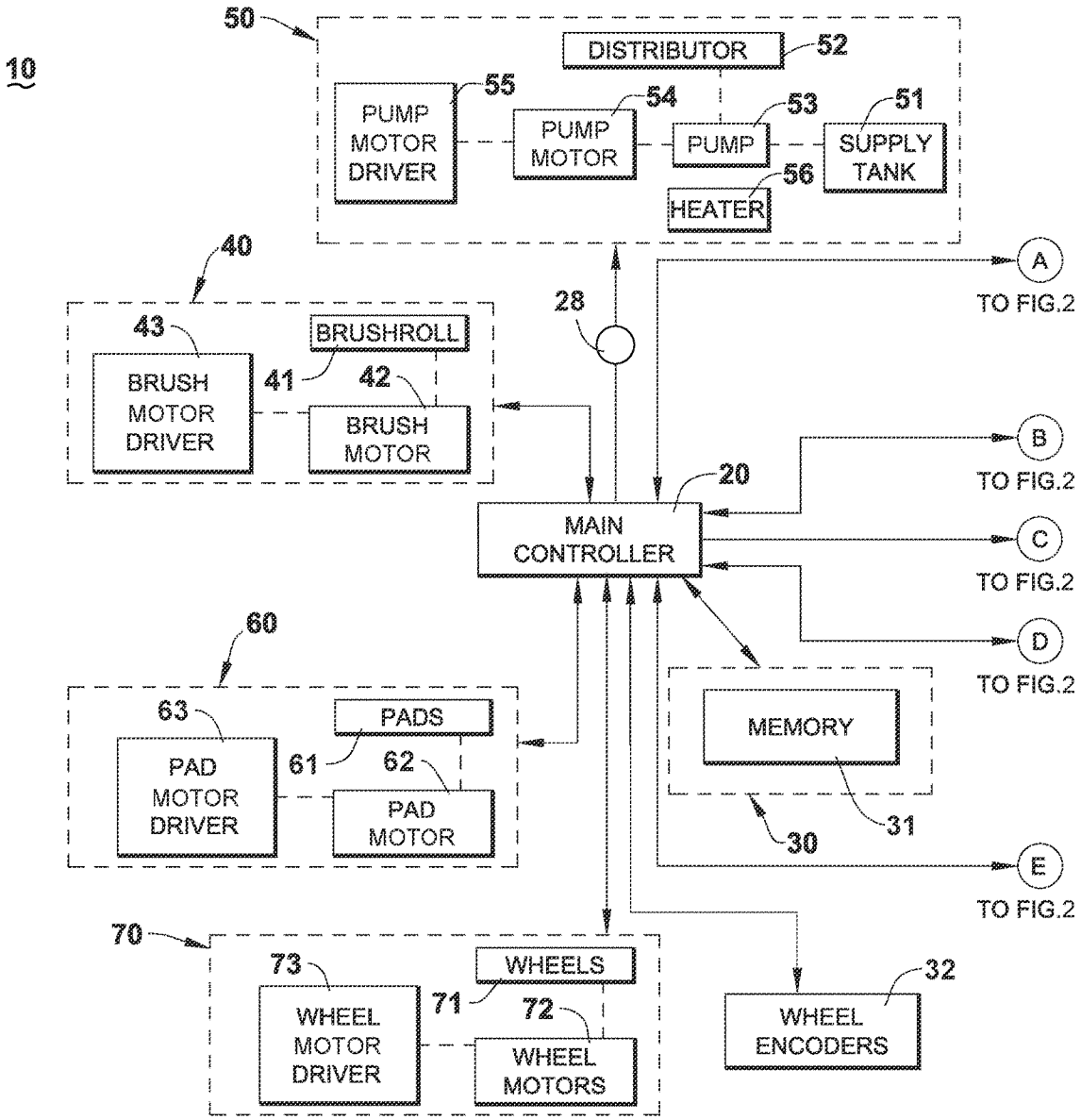
FIG. 1 is a schematic view of an exemplary autonomous floor cleaner illustrating functional systems in accordance with various aspects described herein.
Figure 2:
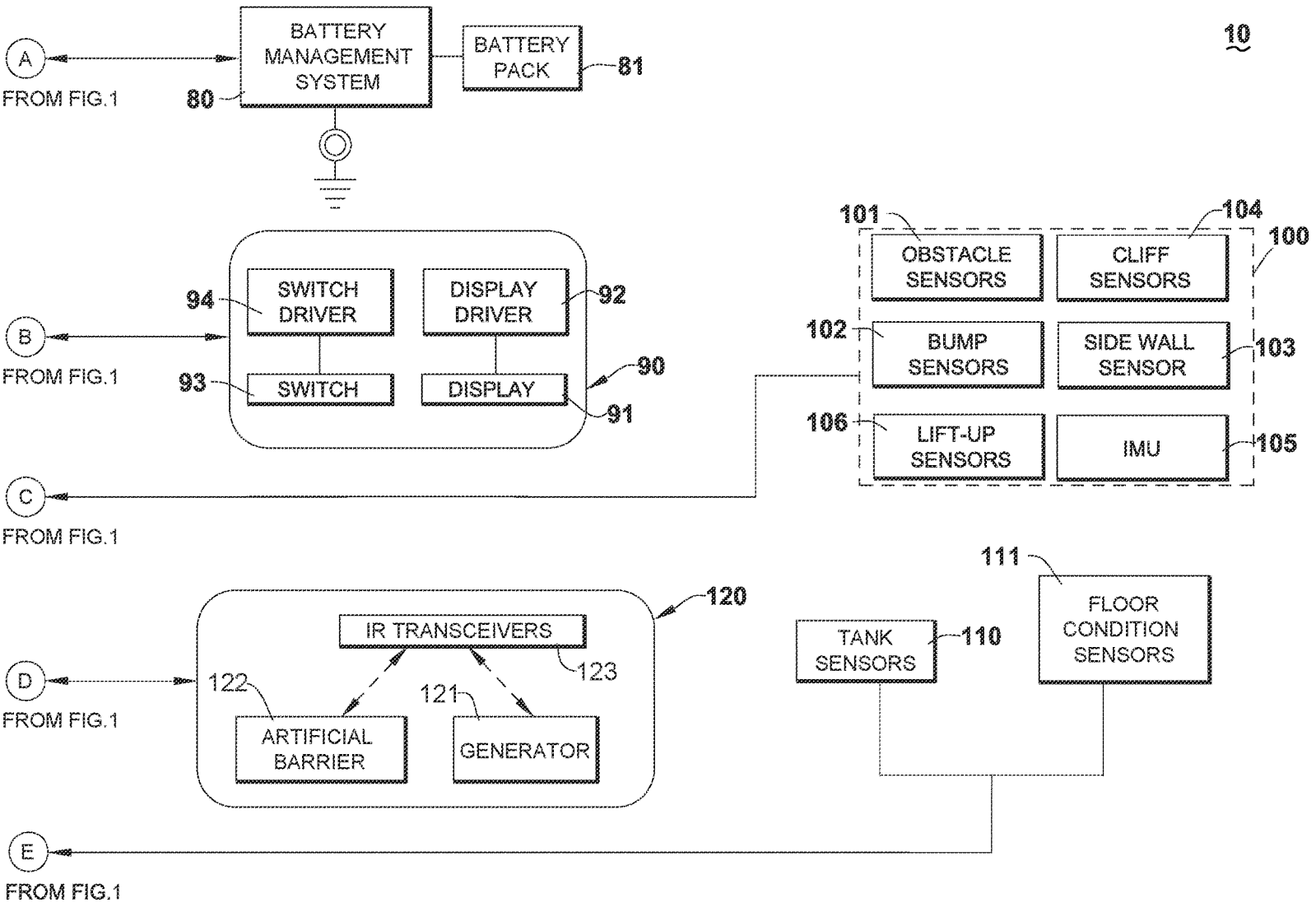
FIG. 2 is a schematic view of the autonomous floor cleaner of FIG. 1 illustrating additional functional systems in accordance with various aspects described herein.

FIGS. 1 and 2 illustrate a schematic view of an autonomous floor cleaner, such as a floor cleaning robot 10, also referred to herein as a robot 10. It is noted that the robot 10 shown is but one example of a floor cleaning robot configured to sweep as well as dust, mop or otherwise conduct a wet cleaning cycle of operation, and that other autonomous cleaners requiring fluid supply or fluid recovery are contemplated, including, but not limited to autonomous floor cleaners capable of delivering liquid, steam, mist, or vapor to the surface to be cleaned.

The robot 10 can include components of various functional systems in an autonomously moveable unit. The robot 10 can include a main housing 12 (FIG. 3) adapted to selectively mount components of the systems to form a unitary movable device. A controller 20 is operably coupled with the various functional systems of the robot 10 for controlling the operation of the robot 10. The controller 20 can be a microcontroller unit (MCU) that contains at least one central processing unit (CPU).

A navigation/mapping system 30 can be provided in the robot 10 for guiding the movement of the robot 10 over the surface to be cleaned, generating and storing maps of the surface to be cleaned, and recording status or other environmental variable information. The controller 20 can receive input from the navigation/mapping system 30 or from a remote device such as a smartphone (not shown) for directing the robot 10 over the surface to be cleaned. The navigation/mapping system 30 can include a memory 31 that can store any data useful for navigation, mapping or conducting a cycle of operation, including, but not limited to, maps for navigation, inputs from various sensors that are used to guide the movement of the robot 10, etc. For example, wheel encoders 32 can be placed on the drive shafts of wheels coupled to the robot 10 and configured to measure a distance traveled by the robot 10. The distance measurement can be provided as input to the controller 20.

In an autonomous mode of operation, the robot 10 can be configured to travel in any pattern useful for cleaning or sanitizing including boustrophedon or alternating rows (that is, the robot 10 travels from right-to-left and left-to-right on alternate rows), spiral trajectories, etc., while cleaning the floor surface, using input from various sensors to change direction or adjust its course as needed to avoid obstacles. In a manual mode of operation, movement of the robot 10 can be controlled using a mobile device such as a smartphone or tablet.

The robot 10 can also include at least the components of a sweeper 40 for removing debris particles from the surface to be cleaned, a fluid delivery system 50 for storing cleaning fluid and delivering the cleaning fluid to the surface to be cleaned, a mopping or dusting assembly 60 for removing moistened dust and other debris from the surface to be cleaned, and a drive system 70 for autonomously moving the robot 10 over the surface to be cleaned.

The sweeper 40 can also include at least one agitator for agitating the surface to be cleaned. The agitator can be in the form of a brushroll 41 mounted for rotation about a substantially horizontal axis, relative to the surface over which the robot 10 moves. A drive assembly including a separate, dedicated brush motor 42 can be provided within the robot 10 to drive the brushroll 41. Other agitators or brushrolls can also be provided, including one or more stationary or non-moving brushes, or one or more brushes that rotate about a substantially vertical axis. In addition, a debris receptacle 44 (FIG. 4) such as a dustbin can be provided to collect dirt or debris from the brushroll 41.

The fluid delivery system 50 can include a supply tank 51 for storing a supply of cleaning fluid and at least one fluid distributor 52 in fluid communication with the supply tank 51 for depositing a cleaning fluid onto the surface. The cleaning fluid can be a liquid such as water or a cleaning solution specifically formulated for hard or soft surface cleaning. The fluid distributor 52 can be one or more spray nozzles provided on the housing 12 with an orifice of sufficient size such that debris does not readily clog the nozzle. Alternatively, the fluid distributor 52 can be a manifold having multiple distributor outlets.

A pump 53 can be provided in the fluid pathway between the supply tank 51 and the at least one fluid distributor 52 to control the flow of fluid to the at least one fluid distributor 52. The pump 53 can be driven by a pump motor 54 to move liquid at any flowrate useful for a cleaning cycle of operation.

Various combinations of optional components can also be incorporated into the fluid delivery system 50, such as a heater 56 or one or more fluid control and mixing valves. The heater 56 can be configured, for example, to warm up the cleaning fluid before it is applied to the surface. In one embodiment, the heater 56 can be an in-line fluid heater between the supply tank 51 and the distributor 52. In another example, the heater 56 can be a steam generating assembly. The steam assembly is in fluid communication with the supply tank 51 such that some or all the liquid applied to the floor surface is heated to vapor.

The dusting assembly 60 can be utilized to disperse the distributed fluid on the floor surface and remove moistened dust and other debris. The dusting assembly 60 can include at least one pad 61 that can optionally be rotatable. For example, the at least one pad 61 can be driven to rotate about a vertical axis that intersects with the center of the respective pad 61. A drive assembly including at least one pad motor 62 can be provided as part of the dusting assembly 60. Each pad 61 can be optionally be detachable for purposes of cleaning and maintenance.

The drive system 70 can include drive wheels 71 for driving the robot 10 across a surface to be cleaned. The drive wheels can be operated by a common wheel motor 72 or individual wheel motors coupled with the drive wheels by a transmission, which may include a gear train assembly or another suitable transmission. The drive system 70 can receive inputs from the controller 20 for driving the robot 10 across a floor, based on inputs from the navigation/mapping system 30 for the autonomous mode of operation or based on inputs from a smartphone for the manual mode of operation. The drive wheels 71 can be driven in a forward or reverse direction to move the unit forwardly or rearwardly. Furthermore, the drive wheels 71 can be operated simultaneously at the same rotational speed for linear motion or independently at different rotational speeds to turn the robot 10 in a desired direction.

The robot 10 can include any number of motors useful for performing locomotion and cleaning. In one example, five dedicated motors can be provided to rotate each of two pads 61, the brushroll 41, and each of two drive wheels 71. In another example, one shared motor can rotate both the pads 61, a second motor can rotate the brushroll 41, and a third and fourth motor can rotate each drive wheel 71. In still another example, one shared motor can rotate the pads 61 and the brushroll 41, and a second and third motor can rotate each drive wheel 71.

In addition, a brush motor driver 43, pump motor driver 55, pad motor driver 63, and wheel motor driver 73 can be provided for controlling the brush motor 42, pump motor 54, pad motors 62, and wheel motors 72, respectively. The motor drivers 43, 55, 63, 73 can act as an interface between the controller 20 and their respective motors 42, 54, 62, 72. The motor drivers 43, 55, 63, 73 can also be an integrated circuit chip (IC). It is also contemplated that a single wheel motor driver 73 can control multiple wheel motors 72 simultaneously.

Turning to FIG. 2, the motor drivers 43, 55, 63, 73 (FIG. 1) can be electrically coupled to a battery management system 80 that includes a built-in rechargeable battery or removable battery pack 81. In one example, the battery pack 81 can include lithium ion batteries. Charging contacts for the battery pack 81 can be provided on an exterior surface of the robot 10. A docking station (not shown) can be provided with corresponding charging contacts that can mate to the charging contacts on the exterior surface of the robot 10. The battery pack 81 can be selectively removable from the robot 10 such that it can be plugged into mains voltage via a DC transformer for replenishment of electrical power, i.e. charging. When inserted into the robot 10, the removable battery pack 81 can be at least partially located outside the housing 12 (FIG. 3) or completely enclosed in a compartment within the housing 12, in non-limiting examples and depending upon the implementation.

The controller 20 is further operably coupled with a user interface (UI) 90 on the robot 10 for receiving inputs from a user. The user interface 90 can be used to select an operation cycle for the robot 10 or otherwise control the operation of the robot 10. The user interface 90 can have a display 91, such as an LED display, for providing visual notifications to the user. A display driver 92 can be provided for controlling the display 91, and acts as an interface between the controller 20 and the display 91. The display driver 92 may be an integrated circuit chip (IC). The robot 10 can further be provided with a speaker (not shown) for providing audible notifications to the user. The robot 10 can further be provided with one or more cameras or stereo cameras (not shown) for acquiring visible notifications from the user. In this way, the user can communicate instructions to the robot 10 by gestures. For example, the user can wave their hand in front of the camera to instruct the robot 10 to stop or move away. The user interface 90 can further have one or more switches 93 that are actuated by the user to provide input to the controller 20 to control the operation of various components of the robot 10. A switch driver 94 can be provided for controlling the switch 93, and acts as an interface between the controller 20 and the switch 93.

The controller 20 can further be operably coupled with various sensors for receiving input about the environment and can use the sensor input to control the operation of the robot 10. The sensors can detect features of the surrounding environment of the robot 10 including, but not limited to, walls, floors, chair legs, table legs, footstools, pets, consumers, and other obstacles. The sensor input can further be stored in the memory or used to develop maps for navigation. Some exemplary sensors are illustrated in FIG. 2, and described below. Although it is understood that not all sensors shown may be provided, additional sensors may be provided, and that all of the possible sensors can be provided in any combination.

The robot 10 can include a positioning or localization system 100. The localization system 100 can include one or more sensors, including but not limited to the sensors described above. In one non-limiting example, the localization system 100 can include obstacle sensors 101 determining the position of the robot 10, such as a stereo camera in a non-limiting example, for distance and position sensing. The obstacle sensors 101 can be mounted to the housing 12 (FIG. 3) of the robot 10, such as in the front of the housing 12 to determine the distance to obstacles in front of the robot 10. Input from the obstacle sensors 101 can be used to slow down or adjust the course of the robot 10 when objects are detected.

Figure 3:
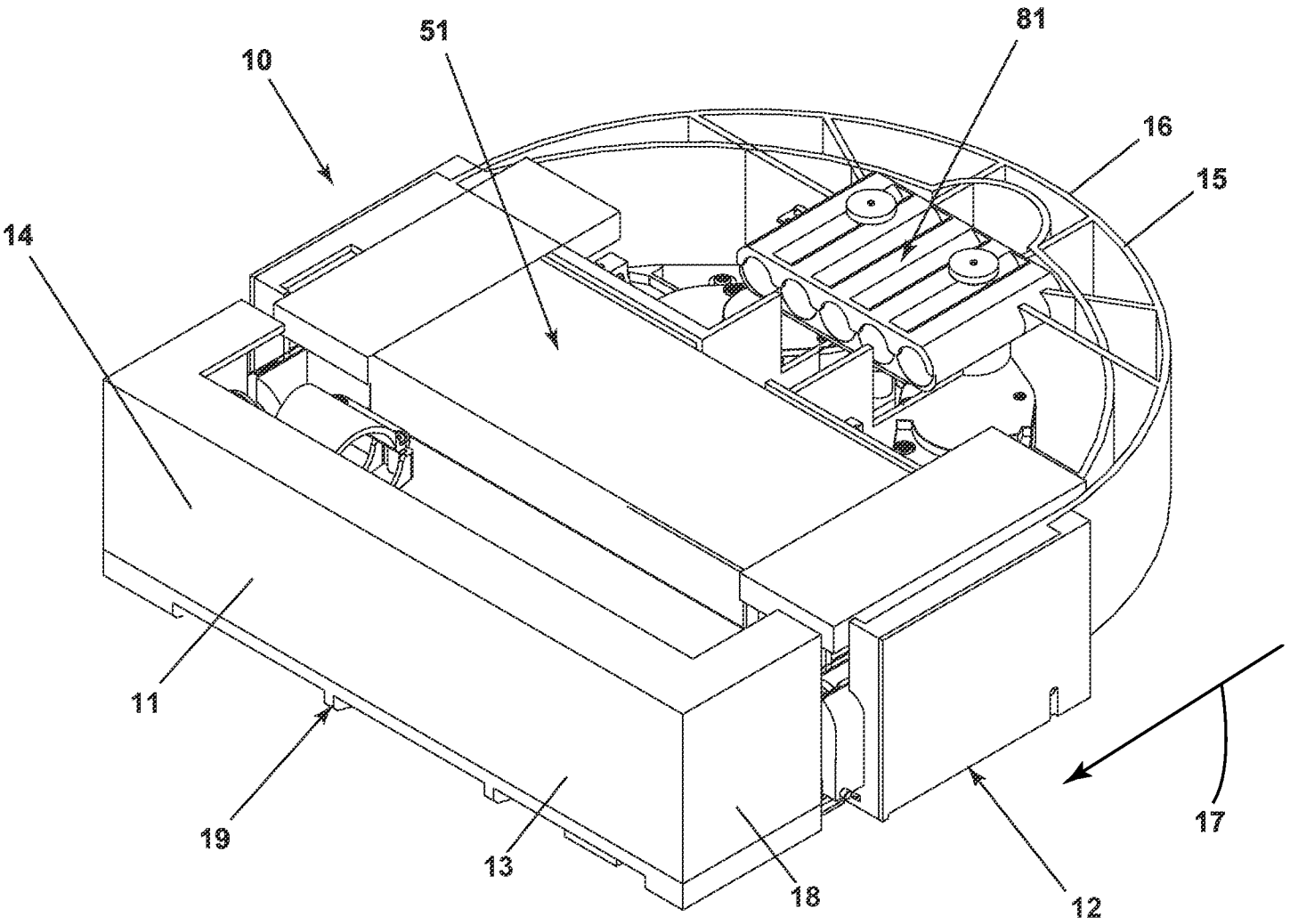
FIG. 3 is an isometric view of the autonomous floor cleaner of FIG. 1 in the form of a floor cleaning robot in accordance with various aspects described herein.

Bump sensors 102 can also be provided in the localization system 100 for determining front or side impacts to the robot 10. The bump sensors 102 may be integrated with the housing 12, such as with a bumper 14 (FIG. 3). Output signals from the bump sensors 102 provide inputs to the controller for selecting an obstacle avoidance algorithm.

The localization system 100 can further include a side wall sensor 103 (also known as a wall following sensor) and a cliff sensor 104. The side wall sensor 103 or cliff sensor 104 can be optical, mechanical, or ultrasonic sensors, including reflective or time-of-flight sensors. The side wall sensor 103 can be located near the side of the housing 12 and can include a side-facing optical position sensor that provides distance feedback and controls the robot 10 so that robot 10 can follow near a wall without contacting the wall. The cliff sensors 104 can be bottom-facing optical position sensors that provide distance feedback and control the robot 10 so that the robot 10 can avoid excessive drops such as stairwells or ledges.

The localization system 100 can also include an inertial measurement unit (IMU) 105 to measure and report the robot's acceleration, angular rate, or magnetic field surrounding the robot 10, using a combination of at least one accelerometer, gyroscope, and, optionally, magnetometer or compass. The inertial measurement unit 105 can be an integrated inertial sensor located on the controller 20 and can be a nine-axis gyroscope or accelerometer to sense linear, rotational or magnetic field acceleration. The IMU 105 can use acceleration input data to calculate and communicate change in velocity and pose to the controller for navigating the robot 10 around the surface to be cleaned.

The localization system 100 can further include one or more lift-up sensors 106 which detect when the robot 10 is lifted off the surface to be cleaned e.g. if a user picks up the robot 10. This information is provided as an input to the controller 20, which can halt operation of the pump motor 54, brush motor 42, pad motor 62, or wheel motors 73 in response to a detected lift-up event. The lift-up sensors 106 may also detect when the robot 10 is in contact with the surface to be cleaned, such as when the user places the robot 10 back on the ground. Upon such input, the controller 20 may resume operation of the pump motor 54, brush motor 42, pad motor 62, or wheel motors 73.

The robot 10 can optionally include one or more tank sensors 110 for detecting a characteristic or status of the supply tank 51 or the debris receptacle 44. In one example, one or more pressure sensors for detecting the weight of the supply tank 51 or the debris receptacle 44 can be provided. In another example, one or more magnetic sensors for detecting the presence of the supply tank 51 or debris receptacle 44 can be provided. This information is provided as an input to the controller 20, which may prevent operation of the robot 10 until the supply tank 51 is filled, the debris receptacle 44 is emptied, or both are properly installed, in non-limiting examples. The controller 20 may also direct the display 91 to provide a notification to the user that either or both of the supply tank 51 and debris receptacle 44 is missing.

The robot 10 can further include one or more floor condition sensors 111 for detecting a condition of the surface to be cleaned. For example, the robot 10 can be provided with an IR dirt sensor, a stain sensor, an odor sensor, or a wet mess sensor. The floor condition sensors 111 provide input to the controller that may direct operation of the robot 10 based on the condition of the surface to be cleaned, such as by selecting or modifying a cleaning cycle. Optionally, the floor condition sensors 111 can also provide input for display on a smartphone.

An artificial barrier system 120 can also be provided for containing the robot 10 within a user-determined boundary. The artificial barrier system 120 can include an artificial barrier generator 121 that comprises a barrier housing with at least one signal receiver for receiving a signal from the robot 10 and at least one IR transmitter for emitting an encoded IR beam towards a predetermined direction for a predetermined period of time. The artificial barrier generator 121 can be battery-powered by rechargeable or non-rechargeable batteries or directly plugged into mains power. In one non-limiting example, the receiver can comprise a microphone configured to sense a predetermined threshold sound level, which corresponds with the sound level emitted by the robot 10 when it is within a predetermined distance away from the artificial barrier generator. Optionally, the artificial barrier generator 121 can further comprise a plurality of IR emitters near the base of the barrier housing configured to emit a plurality of short field IR beams around the base of the barrier housing. The artificial barrier generator 121 can be configured to selectively emit one or more IR beams for a predetermined period of time, but only after the microphone senses the threshold sound level, which indicates the robot 10 is nearby. Thus, the artificial barrier generator 121 can conserve power by emitting IR beams only when the robot 10 is near the artificial barrier generator 121.

The robot 10 can have a plurality of IR transceivers (also referred to as "IR XCVRs") 123 around the perimeter of the robot 10 to sense the IR signals emitted from the artificial barrier generator 121 and output corresponding signals to the controller 20, which can adjust drive wheel control parameters to adjust the position of the robot 10 to avoid boundaries established by the artificial barrier encoded IR beam and the short field IR beams. Based on the received IR signals, the controller 20 prevents the robot 10 from crossing an artificial barrier 122 or colliding with the barrier housing. The IR transceivers 123 can also be used to guide the robot 10 toward the docking station, if provided.

In operation, sound (or light) emitted from the robot 10 greater than a predetermined threshold signal level is sensed by the microphone (or photodetector) and triggers the artificial barrier generator 121 to emit one or more encoded IR beams for a predetermined period of time. The IR transceivers 123 on the robot 10 sense the IR beams and output signals to the controller 20, which then manipulates the drive system 70 to adjust the position of the robot 10 to avoid the barriers 122 established by the artificial barrier system 120 while continuing to perform a cleaning operation on the surface to be cleaned.

The robot 10 can operate in one of a set of modes. The modes can include a wet mode, a dry mode and a sanitization mode. During a wet mode of operation, liquid from the supply tank 51 is applied to the floor surface and both the brushroll 41 and the pads 61 are rotated. During a dry mode of operation, the brushroll 41, the pads 61, or a combination thereof, are rotated and no liquid is applied to the floor surface. During a sanitizing mode of operation, liquid from the supply tank 51 is applied to the floor surface and both the brushroll 41 and the pads 61 are rotated and the robot 10 can select a travel pattern such that the applied liquid remains on the surface of the floor for a predetermined length of time. The predetermined length of time can be any duration that will result in sanitizing floor surfaces including, but not limited to, two to five minutes. However, sanitizing can be effected with durations of less than two minutes and as low as fifteen seconds.

It is also contemplated that the pump 53 (FIG. 1) can be driven according to a pulse-width modulation (PWM) signal 28. Pulse-width modulation is a method of communication by generating a pulsing signal. Pulse-width modulation can be utilized for controlling the amplitude of digital signals in order to control devices and applications requiring power or electricity, such as the pump motor 54. The PWM signal 28 can control an amount of power given to the pump 53 by cycling the on-and-off phases of a digital signal at a predetermined frequency and by varying the width of an "on" phase. The width of the "on" phase is also known as duty cycle, which is expressed as the percentage of being "fully on" (100%). The pump 53 can essentially receive a steady power input with an average voltage value which is the result of the duty cycle and can be less than the maximum voltage capable of being delivered from the battery pack 81. The PWM signal 28 can be transmitted from the controller 20 and configured to provide a set flowrate of deposited cleaning fluid. In one non-limiting example of operation, the PWM signal 28 can cyclically energize the pump 53 for a first predetermined time duration, such as 40 milliseconds, and then de-energize the pump for a second predetermined time duration, such as 2 seconds, at a rate of 50 Hz and a duty cycle of 40%. Higher flow rates can be achieved by, for example, increasing either of both of the duty cycle or frequency. In this manner, the controller 20 can provide for any suitable or customized flow rate, including a low flow rate, from the pump 53 being powered from the battery pack 81.

FIG. 3 illustrates the exemplary robot 10 that can include the systems and functions described in FIGS. 1-2. As shown, the robot 10 can include a D-shaped housing 12 with a first end 13 and a second end 15. The first end 13 defines a housing front 11 of the robot 10 which is a straightedge portion of the D-shaped housing 12, and can be formed by the bumper 14. The second end 15 can define a housing rear 16 which is a rounded portion of the D-shaped housing 12. The battery pack 81 and supply tank 51 can also be mounted to the housing 12 as shown.

Forward motion of the robot 10 is illustrated with an arrow 17, and the bumper 14 wraps around the first end 13 of the robot 10 to provide a lateral portion 18 along the D-shaped front region of the robot 10. In the illustrated example, the bumper 14 includes a lower crenellated structure 19 which is described in more detail below. During a collision with an obstacle, the bumper 14 can shift or translate to register a detection of an object.

Figure 4:
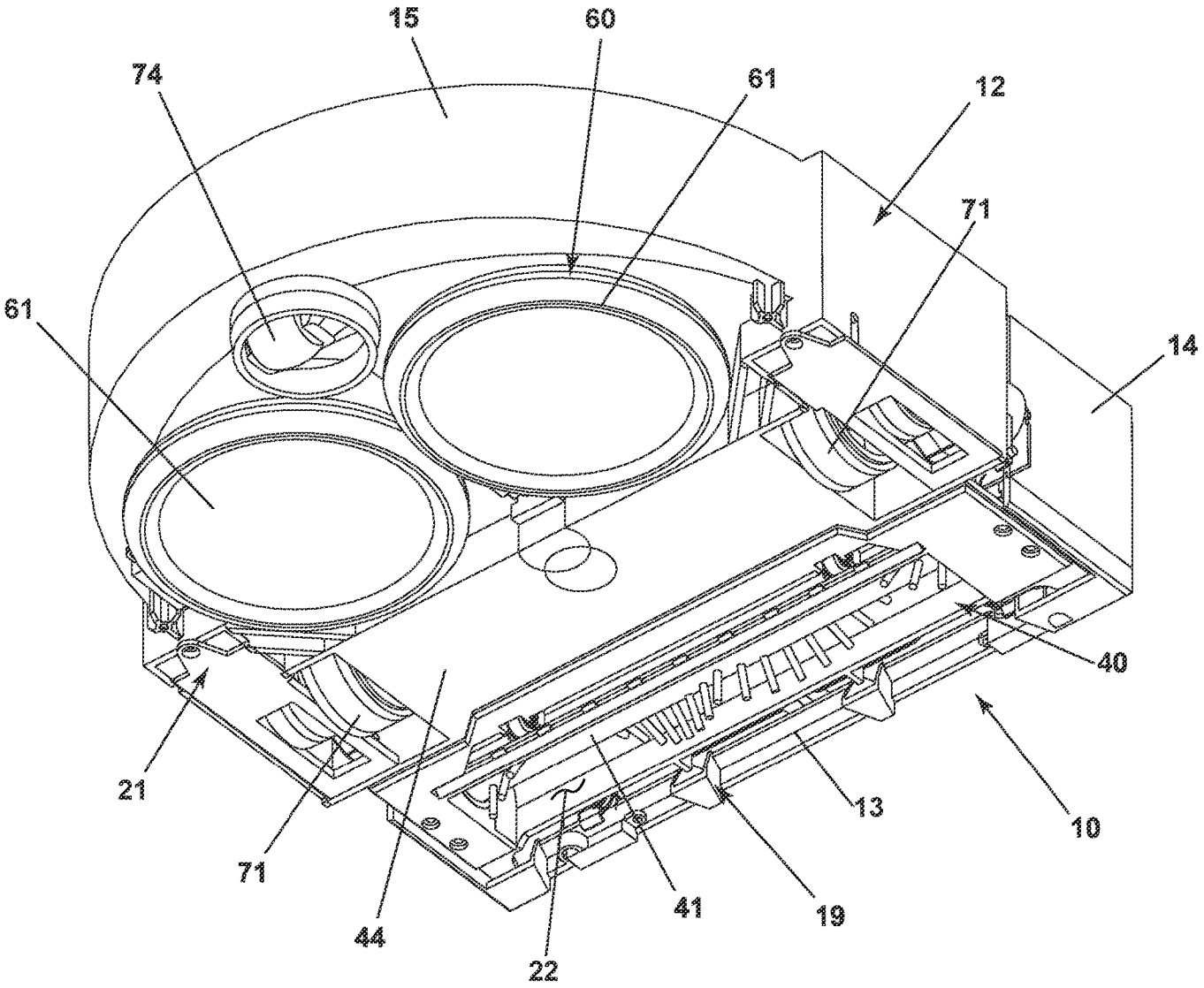
FIG. 4 is an isometric view of the underside of the floor cleaning robot of FIG. 3.

The robot 10 is shown in a lower perspective in FIG. 4, where an underside portion 21 of the housing 12 is visible. The robot 10 can include the sweeper 40 with brushroll 41, at least one wheel assembly with a drive wheel 71, and the dusting assembly 60 which is illustrated with two circular pads 61. The brushroll 41 can be positioned within a brush chamber 22. The brushroll 41 and brush chamber 22 can be located proximate the first end 13, e.g. proximate the straightedge portion of the housing 12. Along the bottom surface of the robot 10 and with respect to forward motion of the robot 10, the sweeper 40 is mounted ahead of the pads 61 and drive wheels 71 are disposed therebetween. In addition, the debris receptacle 44 can be positioned adjacent the brushroll 41 and brush chamber 22. In the illustrated example, the debris receptacle 44 is positioned in line with the drive wheels 71, between the brush chamber 22 and pads 61.

The robot 10 can also include one or more casters 74 set behind the brush chamber 22. The casters 74 can include a wheel mounted on an axle, or an omnidirectional ball for rolling in multiple directions, in non-limiting examples. The one or more casters 74 can, in one example, be utilized to maintain a minimum spacing between the surface to be cleaned and the underside portion 21 of the robot 10.

In another example (not shown), a squeegee can optionally be provided on the housing 12, such as behind the pads 61. In such a case, the squeegee can be configured to contact the surface as the robot 10 moves across the surface to be cleaned. The squeegee can wipe any remaining residual liquid from the surface to be cleaned, thereby leaving a moisture and streak-free finish on the surface to be cleaned. In a dry application, the squeegee can prevent loose debris from being propelled by the brushroll 41 to the rear of the robot 10.

Figure 5:
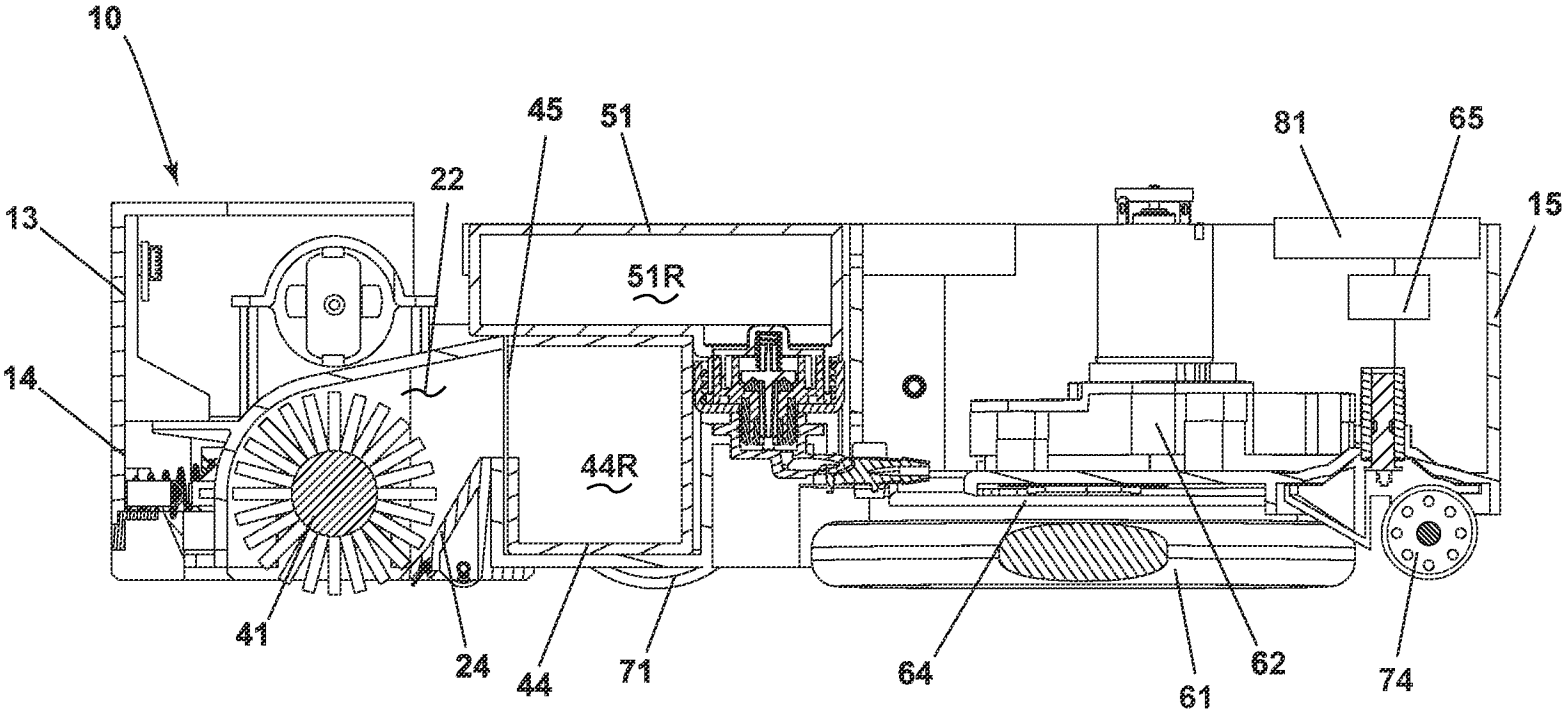
FIG. 5 is a side elevation cross-sectional view of the floor cleaning robot of FIG. 3.

FIG. 5 is a side elevation cross-sectional view of the robot 10. The supply tank 51 and debris receptacle 44 can be separate components within the robot 10. Alternately, the supply tank 51 and debris receptacle 44 can be integrated into a single tank assembly.

The supply tank 51 can define at least one supply reservoir 51R to store liquid for application, via the pump 53 (FIG. 1), to a surface of a floor to be cleaned by the dusting assembly 60. The debris receptacle 44 can define at least one receptacle reservoir 44R and can include a receptacle inlet 45 directly adjacent, and open to, the brush chamber 22. The brush chamber 22 can include a partition having a ramped front surface 24 provided at a bottom of the receptacle inlet 45 to guide debris into the debris receptacle 44. In operation, dirt or debris swept up by rotation of the brushroll 41 can be moved by the brushroll 41 through the brush chamber 22, including along the ramped front surface 24, and propelled through the receptacle inlet 45 into the debris receptacle 44.

Optionally, pad holders 64 can be utilized to mount the circular pads 61 to the housing 12. In such a case, the pad holders 64 can include rotation plates and form the bottom of the base of the dusting assembly 60. The pad holders 64 can include a bottom cover through which a motor shaft of the pad motor 62 extends. The pad motor 62 rotates the motor shaft via a suitable transmission, such as a worm gear assembly that can rotate the pad holder 64 and, consequently, the pad 61. The coupling between the motor shaft and the rotatably driven pad holder 64 defines a vertical axis of rotation for the pad 61.

To remove the pads 61 for cleaning, the dusting assembly 60 can include selectively removable elements. In one non-limiting example, the selectively removable elements can be the pads 61, and in such a case a user or consumer can remove the pads 61 for cleaning or replacement. In another non-limiting example, the removable elements include detachable elements such as the pad holder 64 which couple the pads 61 to the pad motor 62. In such a case, a consumer can release the removable elements (e.g. the pad holders 64) through any suitable decoupling means and can then remove the pads 61 from the removable elements for cleaning or replacement. In one example, the removable elements are released from the robot 10 via an actuator 65 directly coupled to a mechanical catch and latch assembly. It is also contemplated that the pad holders 64 can also be rotatable along with the pads 61 in the dusting assembly 60.

Alternatively, or in addition to the selectively removable elements, a cleaning station (not shown) can be provided to aid in cleaning or replacing the pads 61 of the dusting assembly 60. The robot 10 can be placed on the cleaning station and can apply or assist in a cleaning operation for the pads 61. In one example, the cleaning station can include a surface provided with a plurality of bosses or nubs for agitating the bottom of the pads 61. The robot 10 can activate a self-cleaning mode where the pads 61 are rotated while in contact with the plurality of bosses or nubs to produce an agitation process that mechanically cleans the pads 61.

Figure 6:
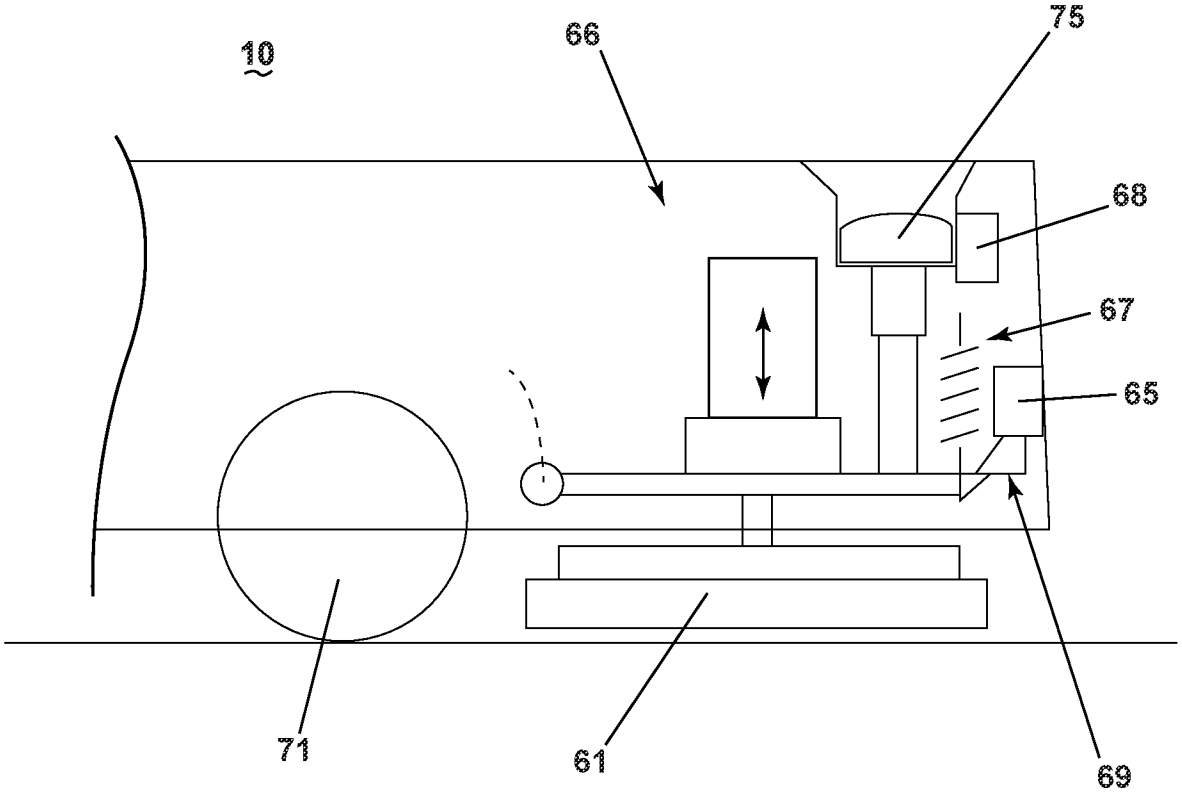
FIG. 6 is a schematic illustration of a dusting assembly of the cleaning robot of FIG. 3.

FIG. 6 illustrates additional details of the dusting assembly 60. The robot 10 can optionally include a pad-lifting assembly 66 that selectively and automatically lifts the pads 61 off the floor surface whenever the robot 10 comes to a complete stop. In the illustrated example, the dusting assembly 60 including the rotating pads 61 are coupled to a movable frame that includes a spring 67 which is biased to provide vertical separation between the pads 61 and the floor surface. A user can initiate a cleaning cycle of operation, for example, by pressing a button 75 that activates a micro-switch 68 and displaces the dusting assembly 60 from a raised position, with the pads 61 out of contact with the floor surface, downwardly to a lowered position in which the pads 61 contact the floor surface. The dusting assembly 60 can be selectively retained in the lowered position by a catch 69 that is selectively movable by another actuator 65 such as a solenoid. The robot 10 can be configured to activate the actuator 65 to move the catch 69 and release the dusting assembly 60 after a cleaning cycle of operation such that the spring 67 urges the dusting assembly 60 to translate back to the raised position. In this manner, the pads 61 can be out of contact with the floor surface while drying, thus preventing streaking and staining of the floor surface directly beneath the pads 61.

In another example (not shown), the pad-lifting assembly 66 can include a caster 74 coupled to an actuator, such as a solenoid, configured to affect a linear motion that extends the caster 74 downward from a first raised position to a second lowered position. The caster 74 can travel downward to contact the surface of the floor and at which point it raises at least a rear portion of the robot 10 until the pads 61 are no longer in contact with the floor surface. In another example, the robot 10 can selectively engage the pad-lifting assembly 66 to raise the pads 61 off the floor surface at the completion of a scheduled cleaning cycle of operation.

Figure 8:
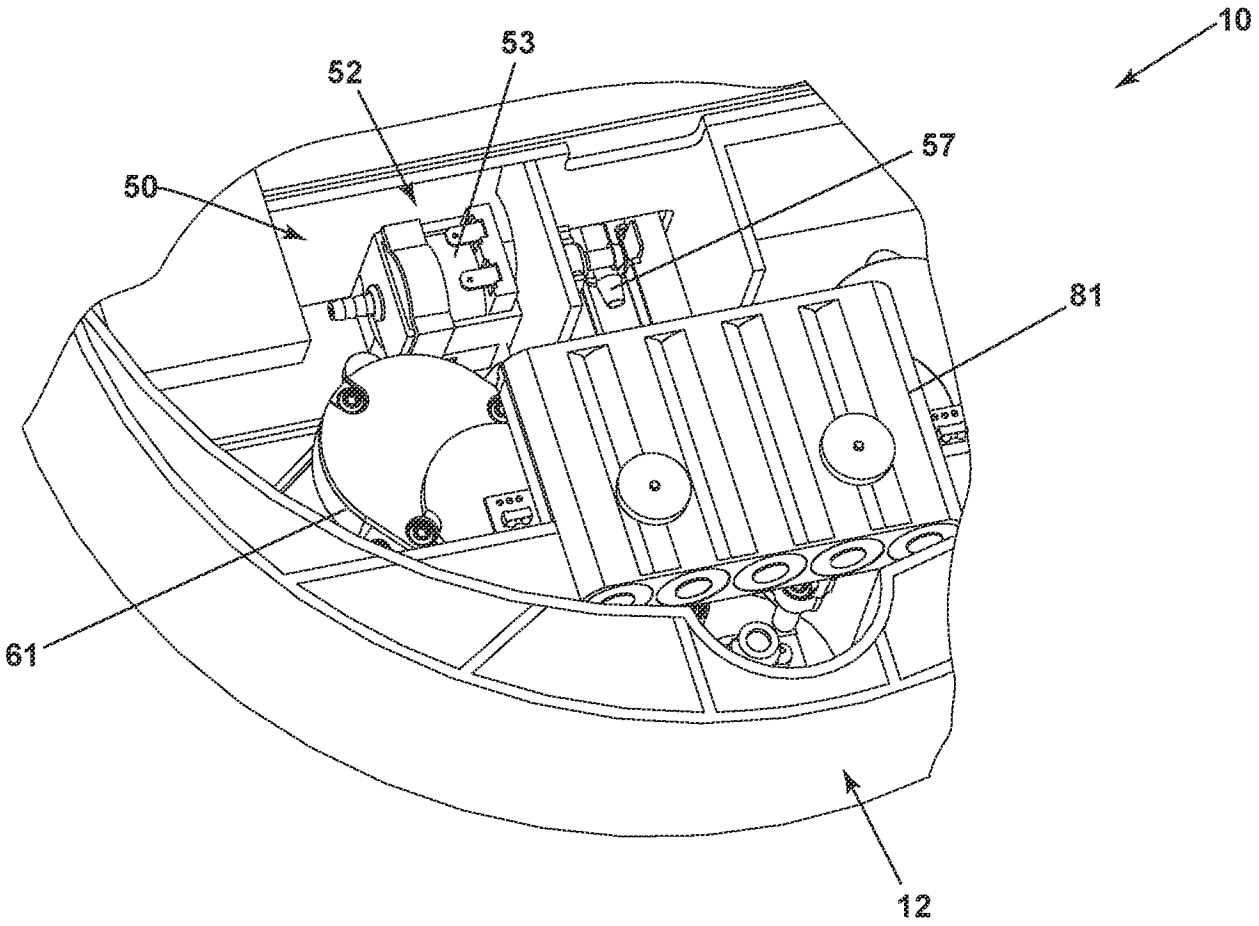
FIG. 8 is an isometric view of the floor cleaning robot of FIG. 3 illustrating a fluid spray nozzle.

In still another example (not shown), the robot 10 can vary the speed and direction of the rotation of the pads 61. The robot 10 can select the speed and rotation according to a cycle of operation to aid or improve cleaning or locomotion of the robot 10. In one example, the pads 61 can counter-rotate such that the front edge of each pad 61 is spinning away from the fluid distributor 52 (FIG. 1) or spray nozzle 57 (FIG. 8). The rate of spinning can include any rate useful for performing a cleaning cycle of operation including, but not limited to a range of rotations per minute from 80 to 120. However, slower and faster rotations may be advantageous for specialized cleaning modes.

Figure 7:
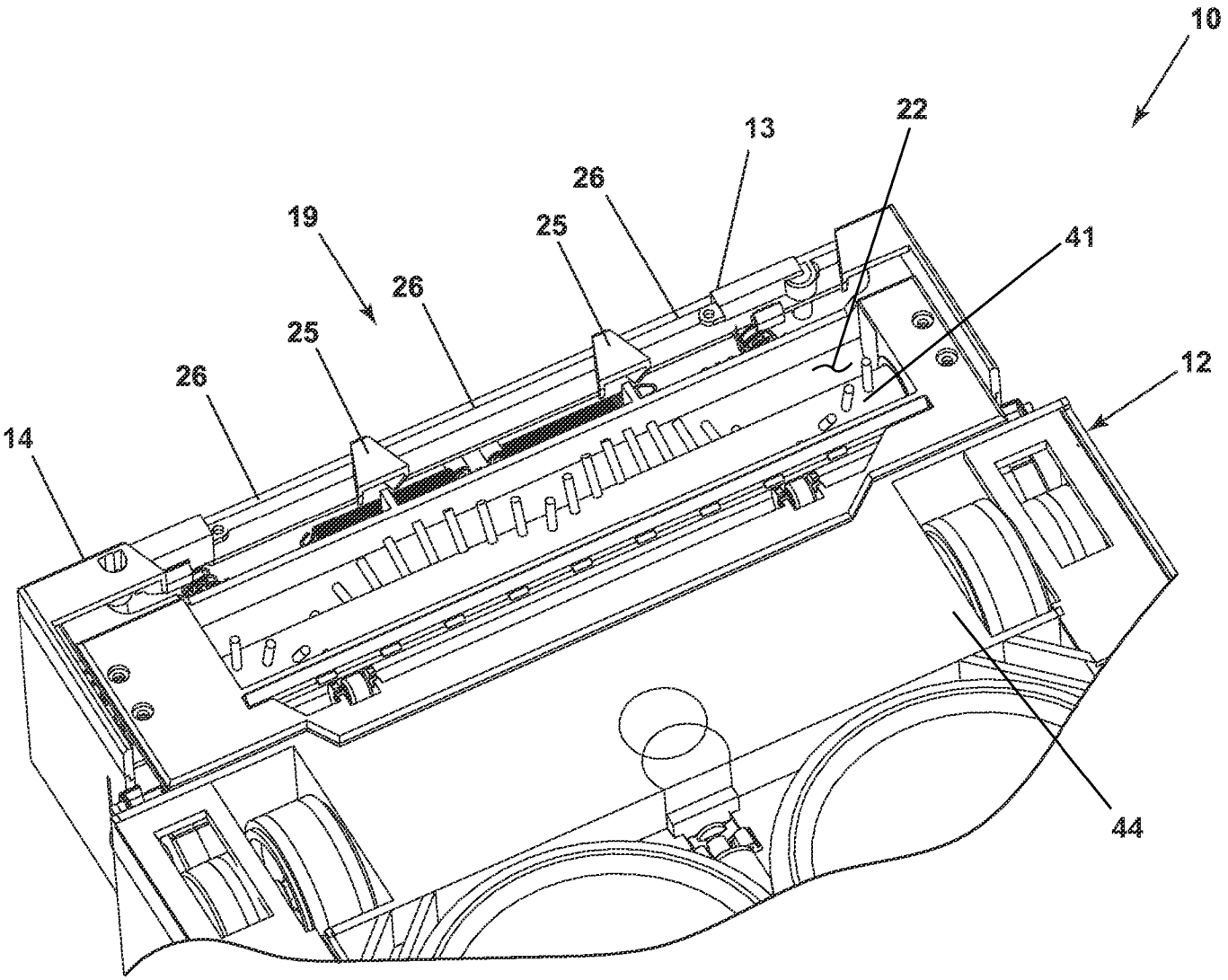
FIG. 7 is an isometric view of the underside of the floor cleaning robot of FIG. 3 illustrating a bumper assembly.

FIG. 7 illustrates the underside of the robot 10 with the bumper 14 shown in additional detail. A lower portion of the bumper 14 can include a crenellated structure 19 of interleaved merlons 25 and crenels 26. In other words, the lower portion of the bumper 14 has a series of projecting lead-ins (merlons 25) that direct debris into the openings (crenels 26) disposed along the lower leading edge of the bumper 14 between adjacent merlons 25. Such a configuration allows the robot 10 to detect surface transitions, such as from a hard surface to an area rug or carpet, through sensors on the forward bumper 14 while also allowing debris to pass through the crenels 26. The merlons 25 can be formed of a substantially trapezoidal cross-section where the shorter base of the trapezoid forms the leading edge of the bumper 14 with respect to the forward motion of the robot 10. In this way, debris can be funneled along the legs of the trapezoidal merlons 25 to the sweeper 40 (e.g. the brushroll 41 and brush chamber 22) configured behind the bumper 14. In another example (not shown), the debris receptacle 44 can include a flapper to prevent the collected debris from inadvertently spilling out of the debris receptacle 44 during removal or transport to a waste container.

FIG. 8 is an isometric view of the robot 10 illustrating further details of the fluid delivery system 50. In the example shown, the distributor 52 includes a spray nozzle 57 fluidly coupled to the supply tank 51 (FIG. 3) via the pump 53. The spray nozzle 57 can be positioned between adjacent pads 61 as shown. In one example, cleaning fluid dispensed from the spray nozzle 57 can be delivered directly to the floor surface, and the rotating pads 61 can absorb and remove the applied cleaning fluid from the floor surface, including during a wet mode of operation of the robot 10 as described above.

Figure 9:
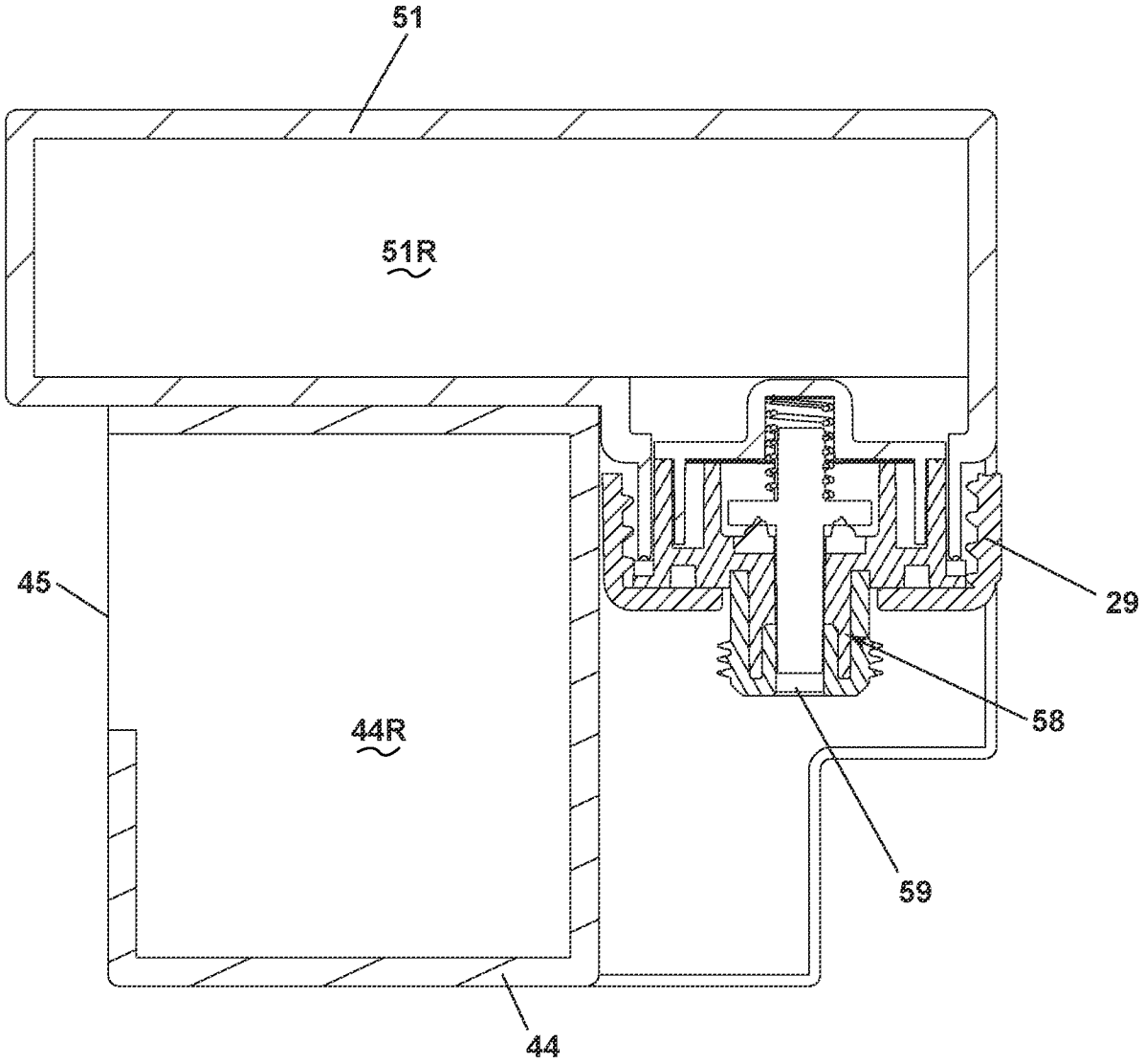
FIG. 9 is a cross-sectional view of a tank assembly in the floor cleaning robot of FIG. 3.

A cross-sectional view of the debris receptacle 44 and supply tank 51 is shown in FIG. 9. The supply tank 51 can further include a valve 58 with an outlet 59 that is fluidly connected to a downstream portion of the fluid delivery system, such as the spray nozzle 57 (FIG. 8). In one example, the valve 58 can comprise a plunger valve removably mounted to an open neck on bottom of the supply tank 51. A mechanical closure 29, such as a threaded cap, can secure the valve 58 to the supply tank 51 and be easily removed for refilling the supply tank 51 when necessary. In the example shown, the supply tank 51 includes a single supply reservoir 51R for water or a combination of water and a cleaning formula. In another example (not shown), the supply tank 51 can includes a first reservoir for storing water and a second reservoir for storing a cleaning formula. It is contemplated that the robot 10 can include multiple supply tanks, a single supply tank with multiple reservoirs or chambers therein, or the like, or combinations thereof for storing cleaning fluid within the robot 10.

Figure 10:
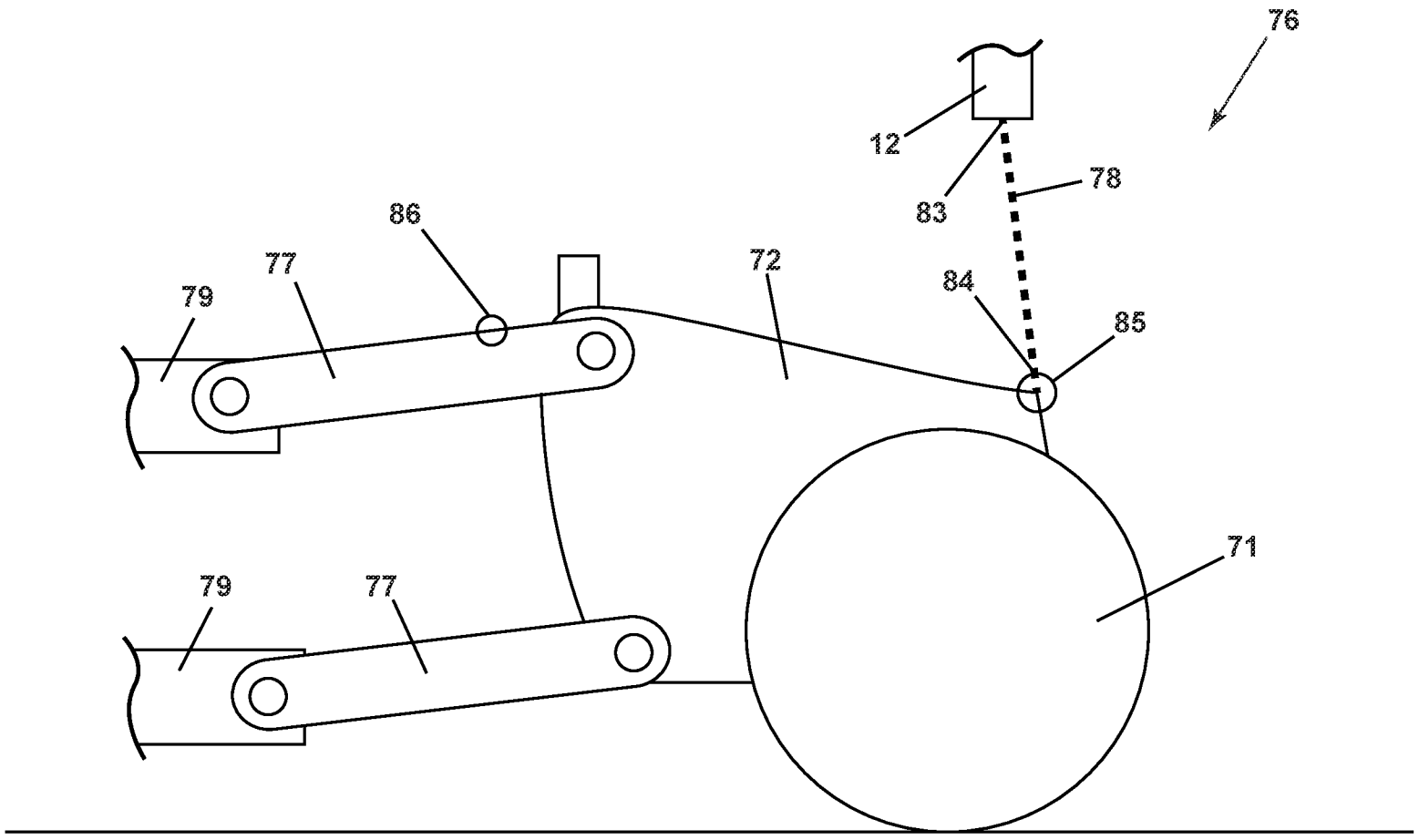
FIG. 10 is a schematic illustration of a wheel assembly that can be utilized in the floor cleaning robot of FIG. 1.

FIG. 10 is a schematic illustration of a wheel assembly 76 of the robot 10 having parallel linkages 77 and an extension spring 78. The wheel assembly 76 in the illustrated example includes one or more drive wheel subassemblies. A drive wheel subassembly includes at least one drive wheel 71 coupled to a wheel housing 79 via at least one linkage 77. The at least one linkage 77 can include any element useful for raising or lowering the wheel 71 with respect to the wheel housing 79. The wheel housing 79 is coupled to the chassis or housing 12 of the robot 10. In addition, the extension spring 78 can include a first end 83 coupled to the housing 12 or a sensor thereon, such as the lift-up sensor 106 (FIG. 2). A second end 84 of the extension spring 78 can couple to any suitable portion of the robot 10, illustrated with an exemplary first position 85 on a housing of the wheel motor 72, or an exemplary second position 86 directly on the at least one linkage 77, in non-limiting examples.

During locomotion of the robot 10, if the drive wheels 71 traverse an obstacle such as a threshold or power cord, the linkages 77 can rotate while the drive wheels 71 can partially rise into the wheel housing 79, aided by the extension spring 78, such that the pads 61 remain in contact with the floor surface. During locomotion of the robot 10, if the drive wheels 71 lose contact with the floor surface, the drive wheels 71 can lower from the wheel housing 79 and indicate that the robot 10 has been lifted from the floor surface.

Figure 11:
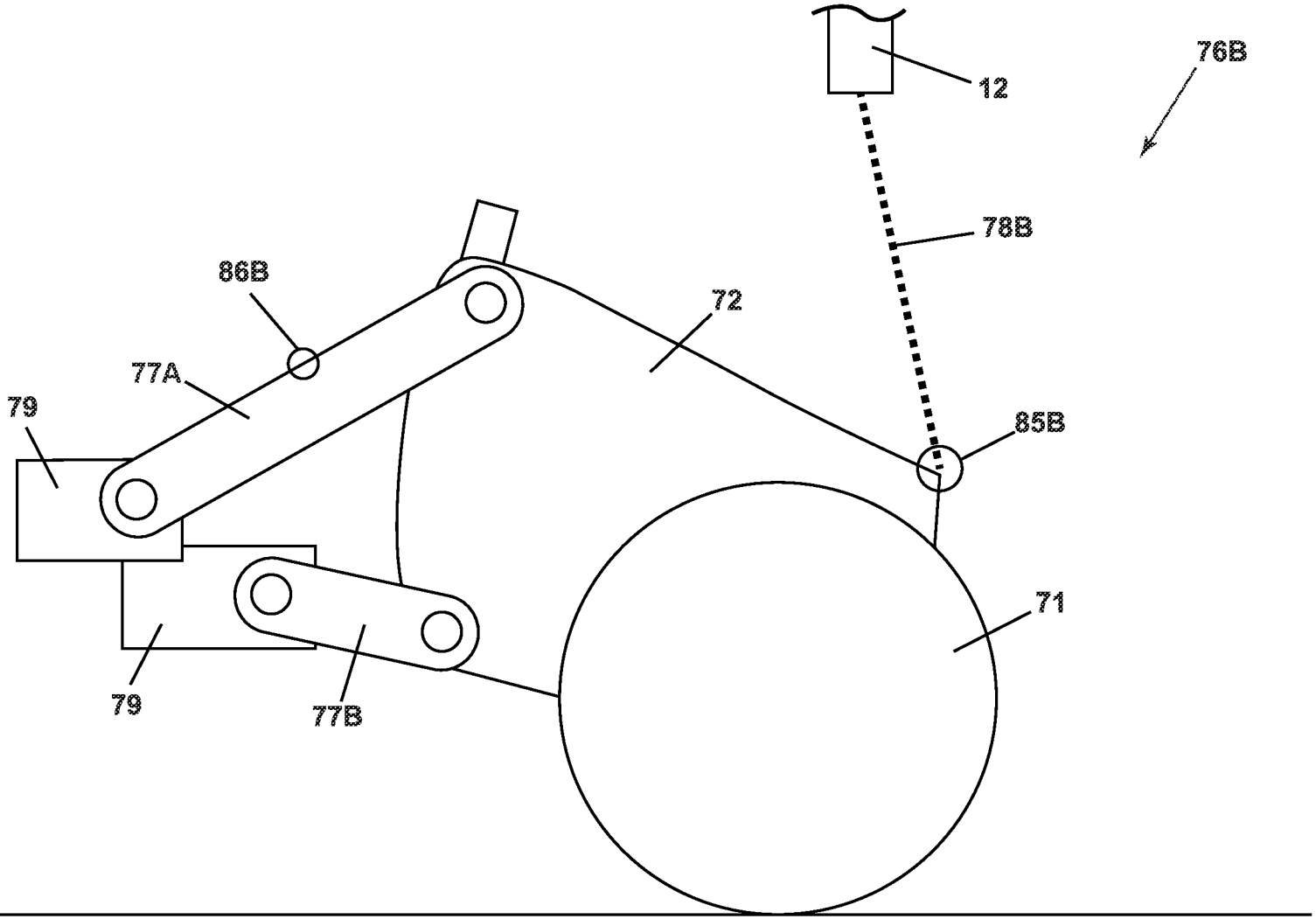
FIG. 11 is a schematic illustration of another wheel assembly that can be utilized in the floor cleaning robot of FIG. 1.

FIG. 11 is a schematic illustration of another wheel assembly 76B similar to the wheel assembly 76. One difference is that the wheel assembly 76B includes a compression spring 78B biasing the drive wheels 71 downward toward the surface to be cleaned. Another difference is that the wheel assembly 76B can include non-parallel first and second linkages 77A, 77B coupling the drive wheels 71 to the wheel housing 79. The non-parallel linkages 77A, 77B, can, in one example, be utilized in combination with the compression spring 78B to direct the drive wheels 71 in a customized direction or path of movement in the event of the robot 10 traversing an obstacle such as a flooring threshold or power cord. The compression spring 78B can be coupled at a first position 85B to the housing of the wheel motor 72, or directly to either of the non-parallel linkages 77A. 77B as illustrated with a second position 86B.

Figure 12:
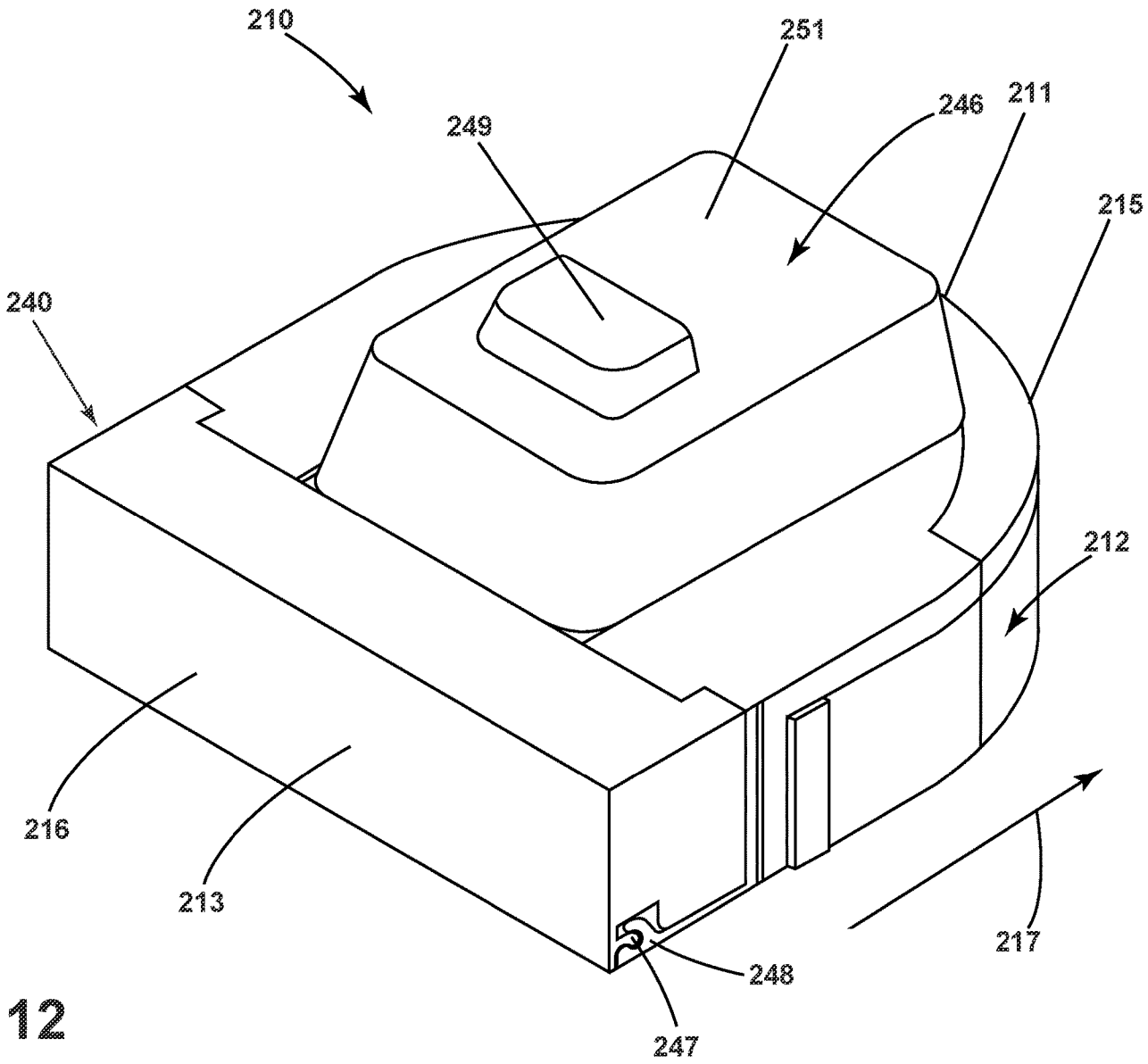
FIG. 12 is an isometric view of another floor cleaning robot in accordance with various aspects described herein.

Referring now to FIG. 12, another autonomous floor cleaner, such as another floor cleaning robot 210 is illustrated that can include the various functions and system as described in FIGS. 1-2. The robot 210 is similar to the robot 10; therefore, like parts will be identified with like numerals increased by 200, with it being understood that the description of the like parts of the robot 10 applies to the robot 210, except where noted.

The robot 210 can include the D-shaped main housing 212 adapted to selectively mount components of the systems to form a unitary movable device. One difference is that the robot 210 can include a sweeper 240 without including a dusting assembly as described above.

Another difference is that the robot 210 can be driven in an opposite direction as compared to the robot 10, where an arrow 217 illustrates a direction of motion of the robot 10 during operation. More specifically, a first end 213 forming a straight-edge portion of the D-shaped housing 212 can define the housing rear 216, and a second end 215 forming a rounded edge of the housing 212 can define the housing front 211.

Figure 13:
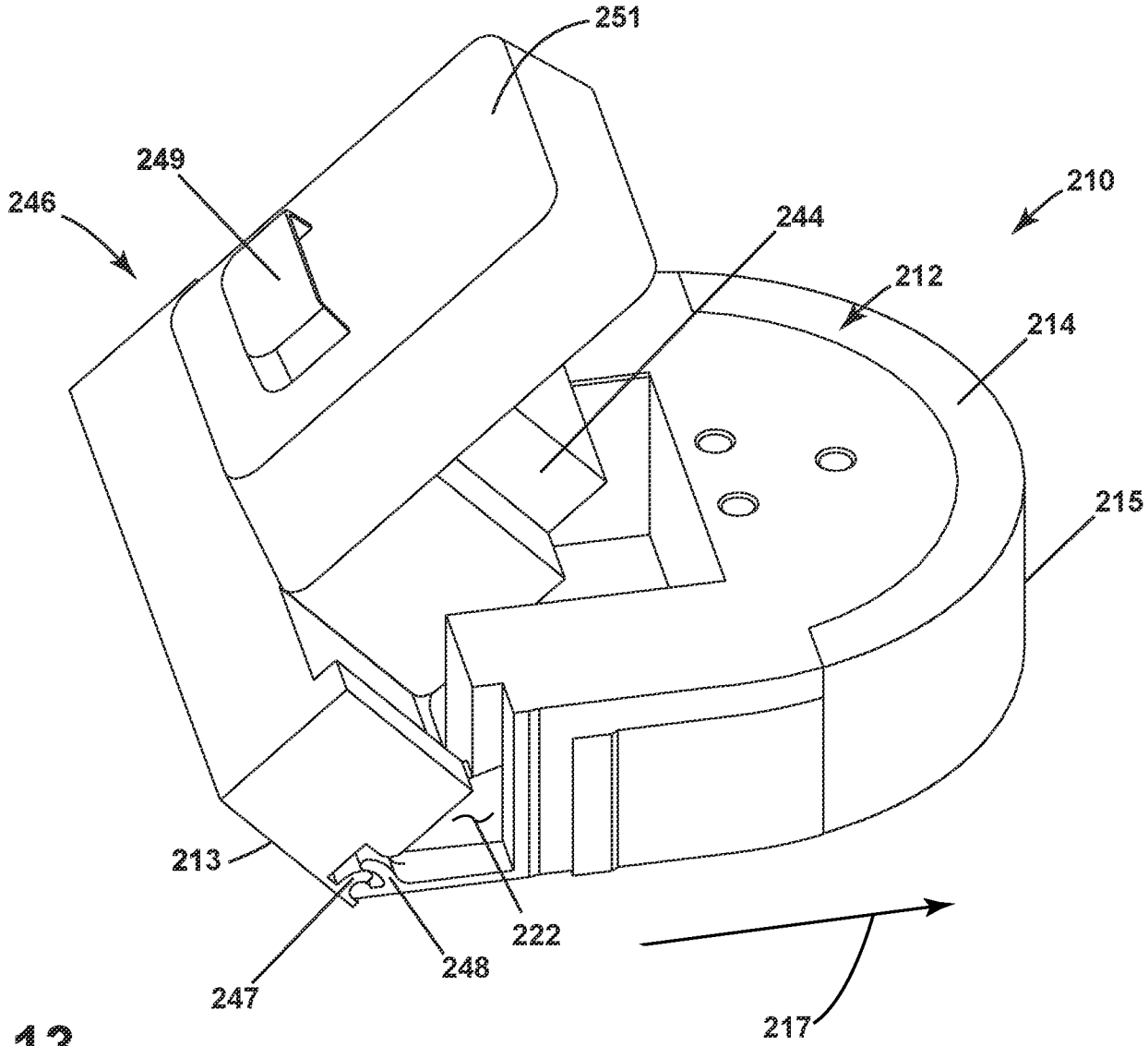
FIG. 13 is an isometric view of the floor cleaning robot of FIG. 12 illustrating a tank assembly.

Another difference is that the robot 210 can further include a unitary or integrated tank assembly 246. Turning to FIG. 13, the integrated tank assembly 246 can include a supply tank 251 and debris receptacle 244. The tank assembly 246 is shown in a partially-removed state from the housing 212. It is contemplated that the tank assembly 246 can be selectively removed by a consumer such that both the supply tank 251 and the debris receptacle 244 are removed together in one action. For example, the tank assembly 246 can include a hook-and-catch mechanism wherein a hook 247 on the tank assembly 246 engages with a catch 248 on the housing 212 of the robot 210. A handle 249 can be provided on the tank assembly 246, wherein a user can grasp the handle 249 and rotate the tank assembly 246 to disengage the tank assembly 246 from the housing 212.

It is further contemplated that the tank assembly 246 can at least partially define the brush chamber 222. The brushroll is not shown in this view for clarity; however, any suitable agitator including one or more brushrolls can be provided. The brush chamber 222 can be open to the debris receptacle 244 as described above. In the illustrated example, the brushroll (not shown) can be located at the rear of the housing 212 when the robot 210 moves in the direction indicated by the arrow 217. Optionally, a bumper 214 can form the second end 215 of the housing 212.

Figure 14:
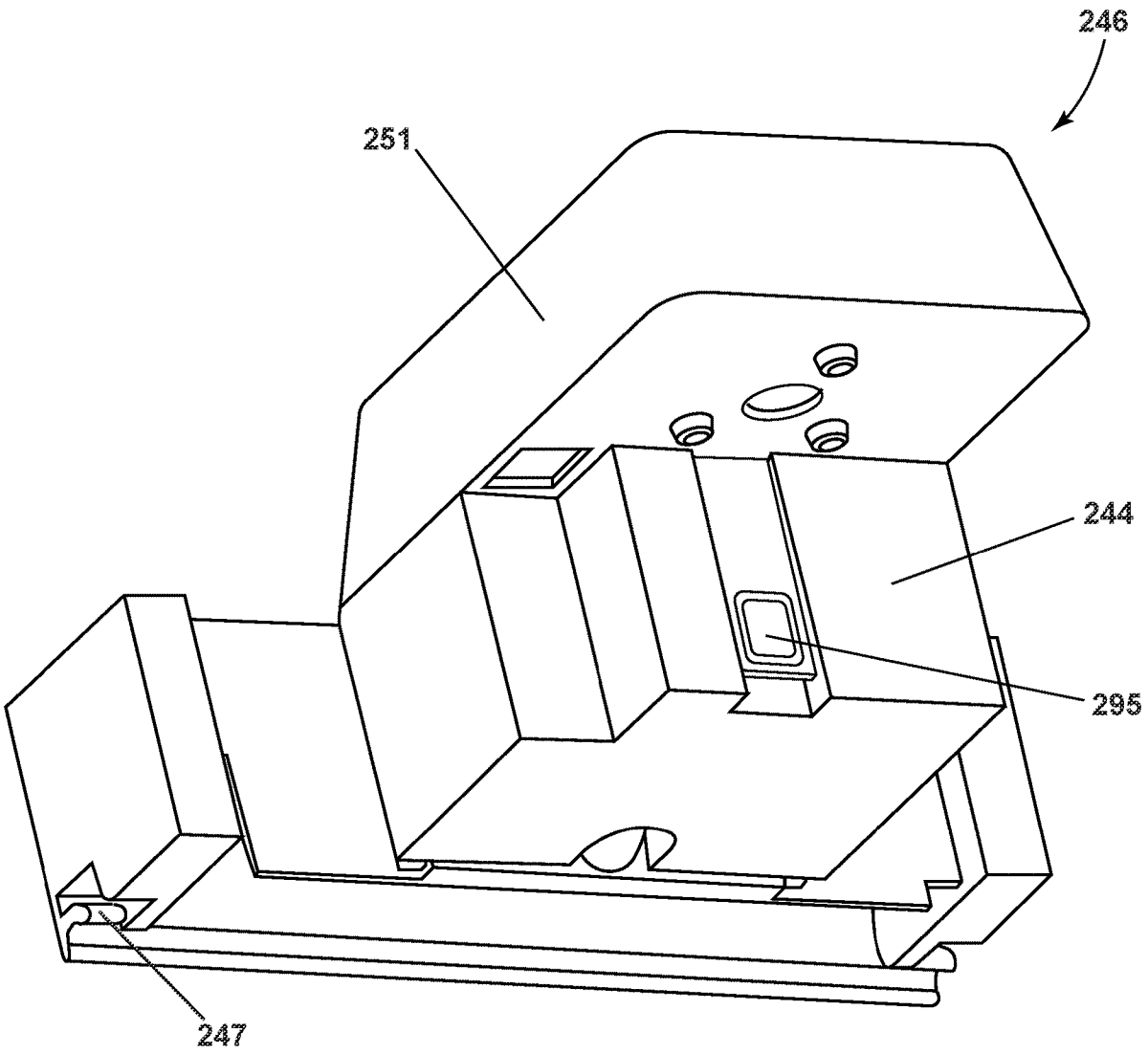
FIG. 14 is an isometric view of the tank assembly of FIG. 13 illustrating a fluid supply tank and a debris receptacle.

FIG. 14 illustrates the tank assembly 246 in isolation with the supply tank 251 and debris receptacle 244. The supply tank 251 can be positioned above the debris receptacle 244. It is further contemplated that the debris receptacle 244 can be selectively removable from the supply tank 251. Any suitable mechanism can be utilized, such as a second hook-and-catch mechanism (not shown) between the supply tank 251 and debris receptacle 244. A release button 295 or other actuator can optionally be provided for selective detachment of the debris receptacle 244 from the tank assembly 246.

Figure 15:
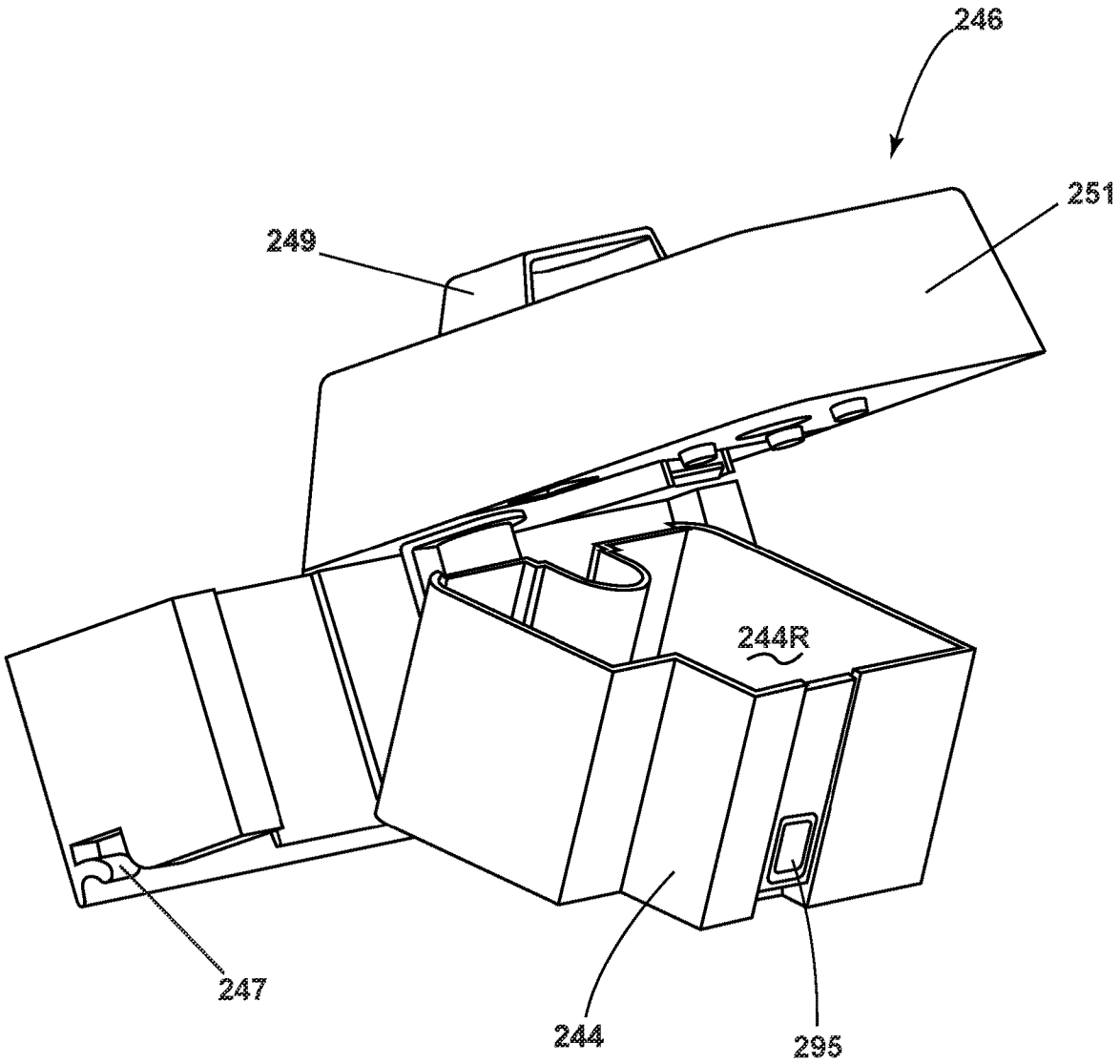
FIG. 15 is an isometric view of the tank assembly of FIG. 14 illustrating a coupling between the fluid supply tank and the debris receptacle.

FIG. 15 illustrates removal of the debris receptacle 244 from the supply tank 251. The debris receptacle 244 can be rotated downward and away from the supply tank 251 to access the receptacle reservoir 244R, such as for complete removal and cleanout of the receptacle 244. It can also be appreciated that removal of the supply tank 251 and debris receptacle 244 in a single integrated tank assembly 246 can improve usability, wherein a consumer can remove the tank assembly 246 in a single action to fill the supply tank 251 with cleaning fluid and remove debris from the receptacle 244.

Figure 17:
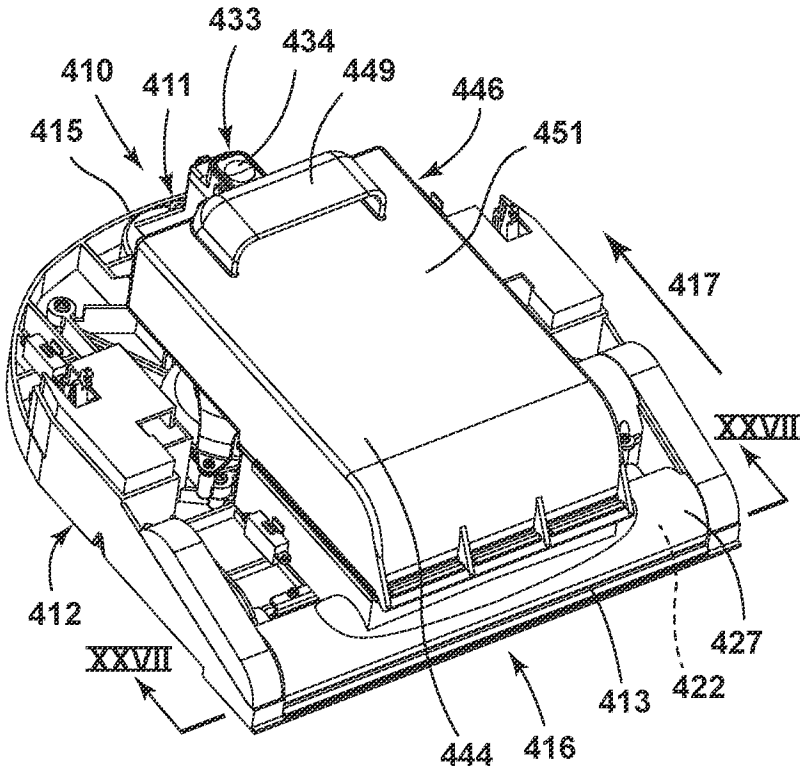
FIG. 17 is a rear isometric view of the floor cleaning robot of FIG. 16.
Figure 16:
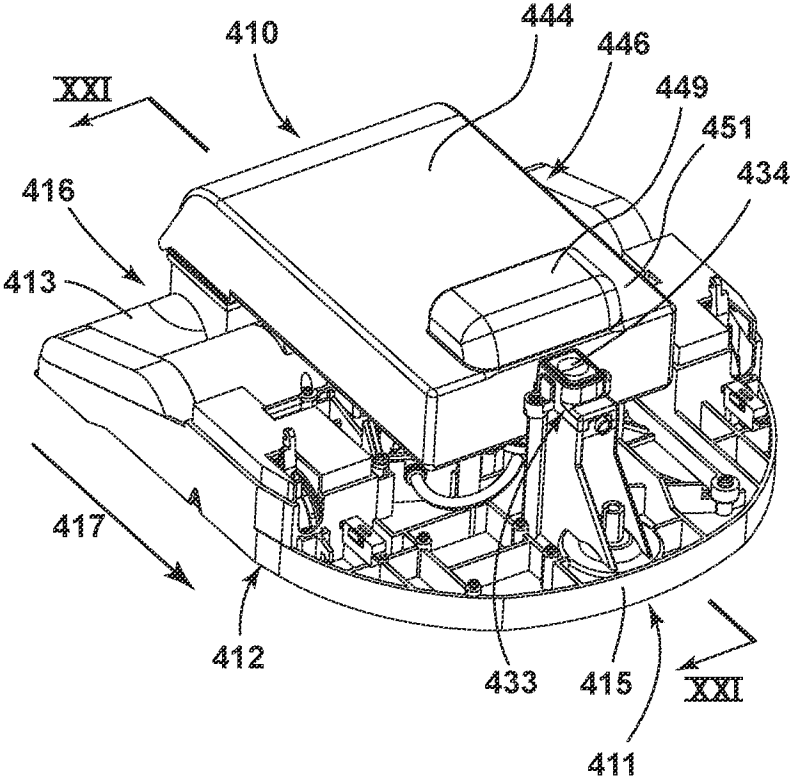
FIG. 16 is a front isometric view of another floor cleaning robot in accordance with various aspects described herein.

Referring now to FIGS. 16-17, another autonomous floor cleaner, such as another floor cleaning robot 410 is illustrated that can include the various functions and system as described in FIGS. 1-2. The robot 410 is similar to the robot 10; therefore, like parts will be identified with like numerals increased by 400, with it being understood that the description of the like parts of the robot 10 applies to the robot 410, except where noted.

The robot 410 can include a D-shaped main housing 412 adapted to selectively mount components of the systems to form a unitary movable device. The D-shaped housing 412 has a first end 413 and a second end 415. The robot 410 can be driven in an opposite direction as compared to the robot 10, where an arrow 417 illustrates a direction of motion of the robot 410 during operation. More specifically, a first end 413 forming a straight-edge portion of the D-shaped housing 412 can define the housing rear 416, and a second end 415 forming a rounded edge of the housing 412 can define the housing front 411. Optionally, a bumper (not shown) can be provided at the second end 415.

Another difference is that the robot 410 can include a vacuum collection or recovery system for removing the liquid and debris from the floor surface, and storing the recovered liquid and debris in a debris receptacle 444 (or recovery tank). The details of one embodiment of the vacuum collection or recovery system for the robot 410 are described in more detail below.

Another difference is that the robot 410 shown does not include a mopping and dusting assembly as described above, although in other embodiments the robot 410 can be provided with one or more vertically-rotating dusting pads as described above.

Another difference is that the robot 410 includes a unitary or integrated tank assembly 446. The integrated tank assembly 446 can include at least a supply tank 451 and the debris receptacle 444. It is further contemplated that the debris receptacle 444 can be selectively removable from the supply tank 451. A cover 427 defining a brush chamber 422 can be formed with or otherwise coupled to the tank assembly 446, and can be removed from the housing 412 along with the tank assembly 446 as one unit.

Figure 18:
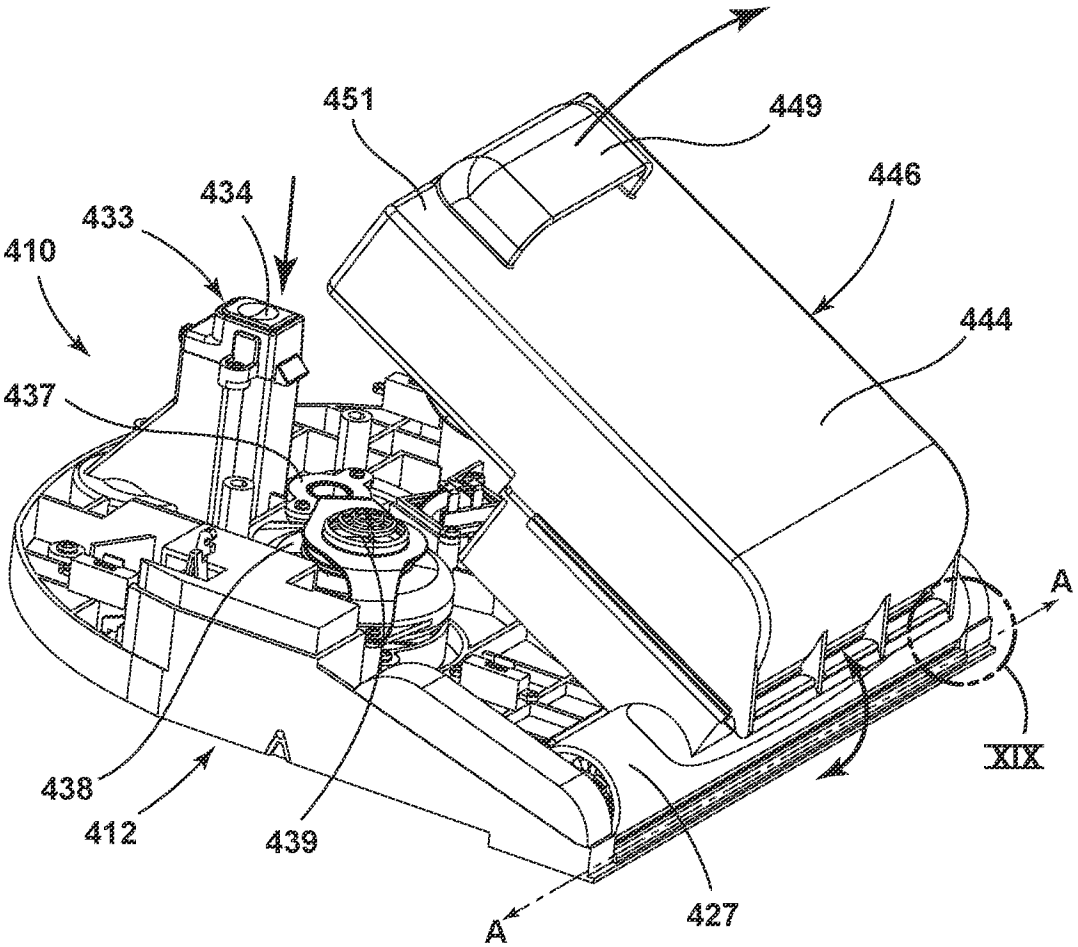
FIG. 18 is a rear isometric view of the floor cleaning robot of FIG. 16, showing a tank assembly in a partially removed state.

Referring to FIG. 18, it is contemplated that the tank assembly 446 can be selectively removed by a consumer such that the supply tank 451, the debris receptacle 444, and the brush chamber 422 are removed together in one action. A handle 449 can be provided on the tank assembly 446, wherein a user can grasp the handle 449 and rotate the tank assembly 446 to disengage the tank assembly 446 from the housing 412. It is contemplated that the handle 449 can serve two purposes. First, when the tank assembly 446 is attached to the housing 412, the handle 449 can be used to carry the entire robot 410. Second, when the tank assembly 446 is not attached to the housing 412, the handle 449 can be used to carry the tank assembly 446.

Figure 19:
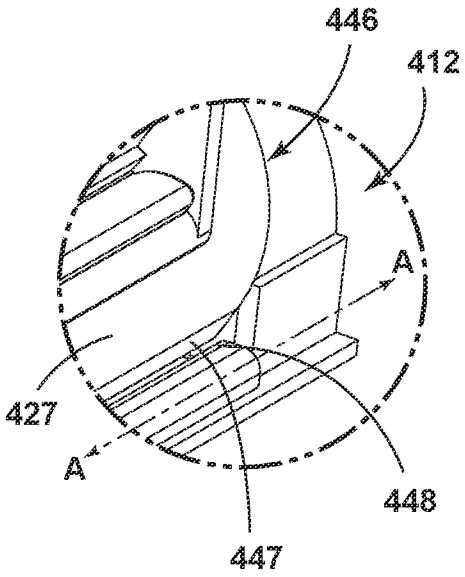
FIG. 19 is a close-up view of section XIX of FIG. 18.

The tank assembly 446 can be attached to the housing 412 using any suitable mechanism. In one exemplary embodiment, referring additionally to FIG. 19, the robot 410 can include a pivot coupling for movement of the tank assembly 446 about axis A, shown herein as a hook-and-catch mechanism that allows the tank assembly 446 to be fully separated from the housing 412. The hook-and-catch mechanism can include a hook 447 on the tank assembly 446 that engages with a catch 448 on the housing 412 of the robot 410. Two hooks 447 can be provided on opposing lateral sides of a rear portion of the tank assembly 446, or on the cover 427, with corresponding catches 448 provided on opposing lateral sides of the first end 313 or housing rear 416 of the housing 412. Alternatively, the hooks 447 can be provided on the housing 412 and the catches 448 can be provided on the tank assembly 446.

In addition, a latch 433 can secure a portion of the tank assembly 446 to the housing 412. Of course, in other embodiments of the robot 410, the tank assembly 446 can be secured to the housing 412 using just a hook-and-catch mechanism or just a latch mechanism. The latch 433 includes a latch actuator, such as a latch button 434 that is depressed by the user to release the tank assembly 446. The latch 433 can be any suitable latch, catch, or other mechanical fastener that can join the tank assembly 446 and housing 412, while allowing for the regular separation of the tank assembly 446 from the housing 412, such as a spring-biased latch operable via the latch button 434.

The tank assembly 446 is shown in a partially-removed state from the housing 412 in FIG. 18. The tank assembly 446 can be removed from the housing 412 by pressing the latch button 434 and rotating the tank assembly 446 as shown in FIG. 18, about an axis A defined by the hook-and-catch mechanism. Once the hooks 447 have cleared the catches 448, the tank assembly 446 can be lifted upwardly away from the housing 412. This process can be performed with one hand. Optionally, the handle 449 can be proximate to, i.e. lie close enough to, the latch button 434 so that the consumer can grip the handle 449 with one hand and actuate the latch 433 using the same hand, e.g. press the latch button 434 with a finger or thumb of the same hand. Having the tank assembly 446 removable from the top side of the housing 412 also provides a benefit for charging or docking the robot 410 because the tank assembly 446 can be removed when the robot 410 is seated in the charging cradle or docking station.

Having the latch 433 on the housing 412 and the handle 449 on the tank assembly 246 can provide some further benefits to the tank removal process. The consumer must provide opposing forces to lift the tank assembly 446 upwardly while simultaneously pressing downward on the housing 412. This helps create a clean breakaway between the two assemblies and keeps the housing 412 in position during removal of the tank assembly 446. This can be particularly helpful if the robot 410 is in a charging cradle or at a docking station when the consumer removes the tank assembly 446. The tank assembly 446 can be removed without disturbing any electrical contact needed for charging the battery (not shown).

The tank assembly 446 combines the supply tank 451, debris receptacle 444, and brush chamber 422 in one unitary assembly or module. These parts of the robot 410 are serviced most frequently, and providing them in a single unit allows the consumer to easily remove them. After a cleaning operation, the debris receptacle 444 is emptied and rinsed along with the brush chamber 422 since these two parts make up the recovery pathway for liquid and debris. The supply tank 451 will also most likely need to be refilled after each operation.

Figure 20:
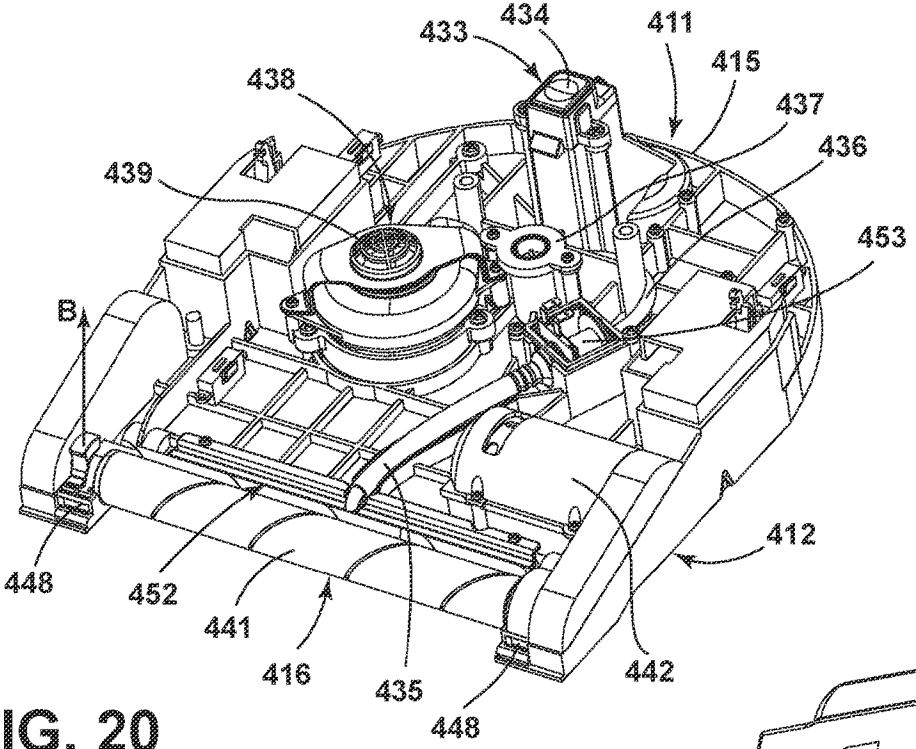
FIG. 20 is a rear isometric view of the floor cleaning robot of FIG. 16, with the tank assembly removed for clarity.

As shown in FIG. 20, removing the tank assembly 446 from the housing 412 will expose the brushroll 441 and allows the consumer to easily access the brushroll 441. With the tank assembly 446 removed, the consumer can remove the brushroll 441 by lifting one end of the brushroll upwardly, as indicated by arrow B in FIG. 20. The consumer can then carry the brushroll 441, optionally along with the tank assembly 446, to a sink for service. The brushroll 441 can be rinsed after a cleaning operation; optionally, the user can manually remove hair and other debris as well.

After servicing, the user can easily reassemble the brushroll 441 and the tank assembly 446 back on the housing 412, optionally after allowing one or both to dry, to prepare the robot 410 for its next cleaning operation. As noted above, while servicing or allowing the serviced components to dry, the housing 412 can be docked and charging.

Still referring to FIG. 20, in addition to the supply tank 451, the fluid delivery system can include at least one fluid distributor 452 in fluid communication with the supply tank 451 for depositing a cleaning fluid onto the surface. The fluid distributor 452 shown is a manifold having multiple distributor outlets. Other configuration for the fluid distributor 452 are possible. The fluid distributor 452 can optionally be arranged forwardly of the brush chamber 422 to distribute liquid in front of the brushroll 441, with reference to the front and rear portions 411, 416 of the robot 410.

A pump 453 is provided in the fluid pathway between the supply tank 451 and the fluid distributor 452, and is coupled to an inlet of the fluid distributor 452 by a first conduit 435. A second conduit 436 couples the pump 453 to a valve receiver 437 on the housing 412 for fluidly coupling with the supply tank 451 when the tank assembly 446 is seated within the housing 12. As discussed above, the pump 453 can be driven according to a pulse-width modulation (PWM) signal 28 (FIG. 1).

The recovery system can include a recovery pathway through the robot 410 having an air inlet and an air outlet, the debris receptacle 444 for receiving recovered liquid and debris for later disposal, and a suction source 438 in fluid communication with the brush chamber 422 and the debris receptacle 444 for generating a working airstream through the recovery pathway. The suction source 438 can include a vacuum motor located fluidly upstream of the air outlet, and can define a portion of the recovery pathway. Optionally, a pre-motor filter and/or a post-motor filter (not shown) can be provided in the recovery pathway as well. The recovery pathway can further include various conduits, ducts, or tubes for fluid communication between the various components of the vacuum collection system.

The suction source 438 can be positioned downstream of the debris receptacle 444 in the recovery pathway. The suction source 438 can include a motor air inlet port 439 for coupling the debris receptacle 444 with the suction source 438. In other embodiments, the suction source 438 may be located fluidly upstream of the debris receptacle 444.

Figure 21:
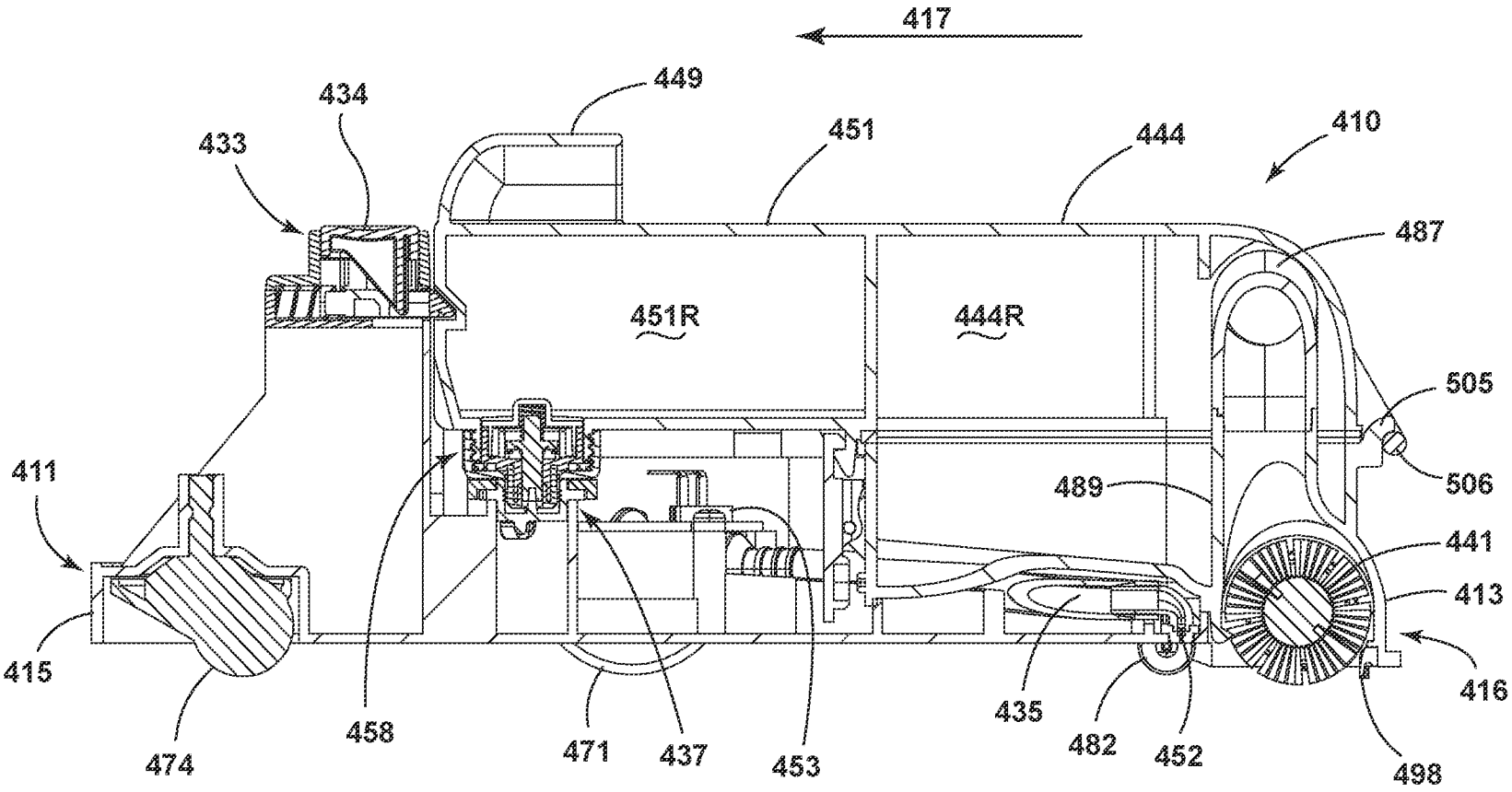
FIG. 21 is a cross-sectional view taken through line XXI-XXI of FIG. 16.

FIG. 21 is a side elevation cross-sectional view of the robot 410. The supply tank 451 can define at least one supply reservoir 451R to store liquid for application, via the pump 453, to a surface of a floor to be cleaned. The debris receptacle 444 can define at least one receptacle reservoir 444R and can include a separator 487 for separating liquid and debris from the working airstream.

The recovery system of the robot 410 can include a dirty inlet defined by a suction conduit 489. The dirty inlet or suction conduit 489 can be any type of suction inlet suitable for the purposes described herein, including the collection of debris and liquid from the brushroll 441. In the illustrated embodiment, the dirty inlet or suction conduit 489 comprises an elongated duct extending from a brush chamber 422 that receives the brushroll 441, and fluidly couples the brush chamber 422 with the separator 487. The suction conduit 489 pulls debris and excess liquid from the brushroll 441. The brush chamber 422 helps define the air flow that goes through the suction conduit 489 and into the debris receptacle 444. The suction conduit 489 can extend to or be integrally formed with the separator 487.

The debris receptacle 444 can be positioned behind the supply tank 451, relative to the direction of forward travel 417 of the robot 410. The brush chamber 422 is located proximate the first end 413, e.g. proximate the straightedge portion of the housing 412 defining the housing rear 416.

In addition to the drive wheels 471 and caster 474, the robot 410 can also include one or more additional wheels 482 proximate to the first end 413 of the housing 412. The additional wheels 482 can, in one example, be utilized to maintain a minimum spacing between the surface to be cleaned and the underside of the housing rear 416. The caster 374 can be disposed proximate to the second end 415 of the housing 412 to maintain a minimum spacing between the surface to be cleaned and the underside of the housing front 11.

Figure 22:
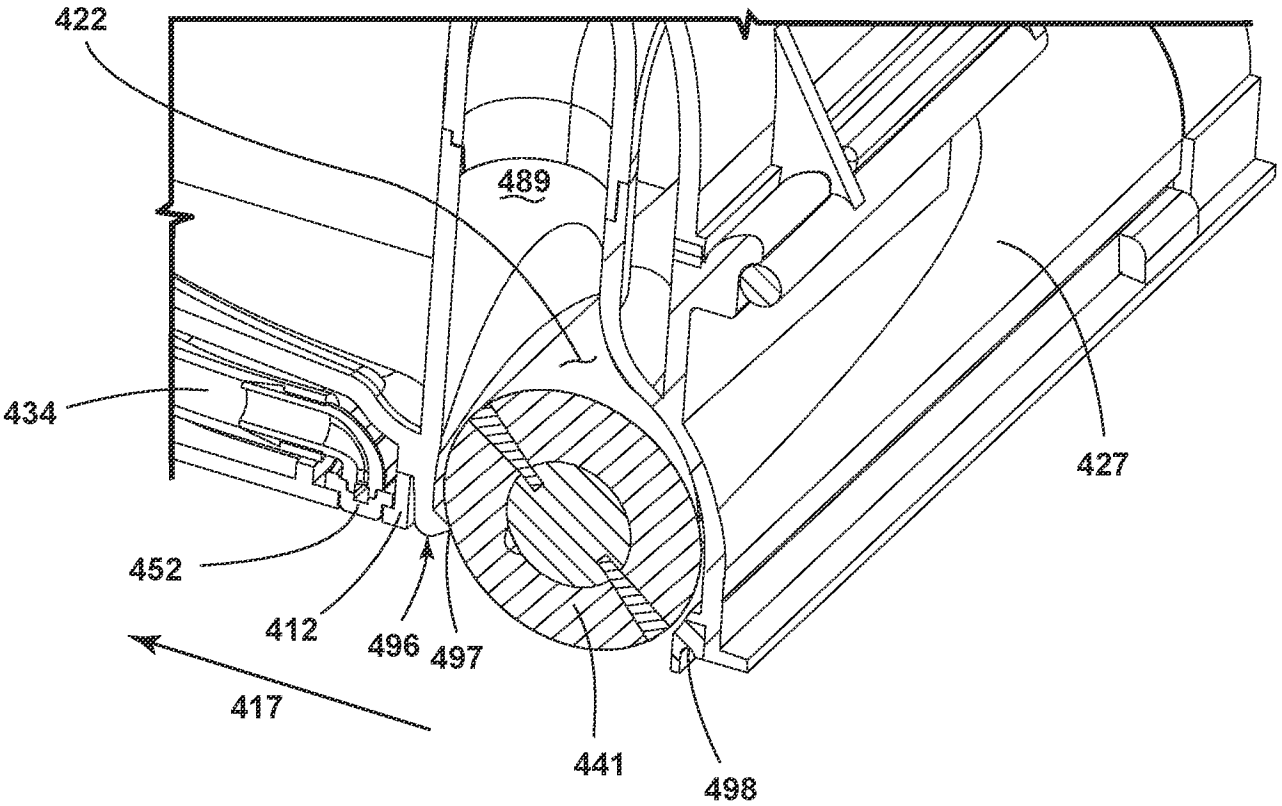
FIG. 22 is a close-up isometric cross-sectional view taken through line XXI-XXI of FIG. 16, showing a brush chamber of the floor cleaning robot FIG. 21.

FIG. 22 is a cross-sectional view taken through the brush chamber 422. The brush chamber 422 substantially surrounds the front, back, and top sides of the brushroll 441 and is defined by the cover 427. The brush chamber 422 is open at the bottom side of brushroll 441 for engagement of the brushroll 411 with the surface to be cleaned. In the illustrated embodiment, the cover 427 extends over the housing 412 so that the housing 412 is not exposed to the brushroll 441, and is in particular not exposed to ingested debris and liquid. This prevents debris from collecting on the housing 412. Rather, debris not ingested into the debris receptacle 444 instead can collect on the cover 427 and in the suction conduit 489 extending to debris receptacle 444. Since these portions are removable along with the tank assembly 446, all dirt collected by the robot 410 will be able to be cleaned out at the sink or other waste receptacle. In other words, all surfaces of the robot 410 forming the recovery pathway are removable and easily cleanable.

In some embodiments, the brush chamber 422 includes a scraper 496 that removes liquid and debris from the brushroll 441 and keeps it in the brush chamber 422 so that it can be removed by the suction conduit 489. The scraper 496 can be mounted to or otherwise provided within the brush chamber 422, and can extend toward the brushroll 441 to interface with a portion of the brushroll 441. More specifically, the scraper 496 is configured to engage with a forward portion of the brushroll 441, as defined by the direction of forward travel 417 of the robot 410. As the brushroll 441 rotates, the scraper 496 can scrape liquid and debris off the brushroll 441. The scraper 496 can additionally can help redistribute liquid evenly along the length of the brushroll 441, which can help to reduce streaking on the surface to be cleaned.

In one embodiment, the scraper 496 can be an elongated rib, wiper, or blade that generally spans the transverse length of the brushroll 441. The scraper 496 can have a thin or narrow edge 497 that engages the brushroll 441, and can optionally taper to the thin or narrow edge 497. Optionally, the edge 497 can be disposed generally orthogonally to the portion of the brushroll 441 which it engages. Alternatively, the edge 497 can be disposed at an angle to the brushroll 441.

The scraper 496 can be provided on the inside of the cover 427 to project into the brush chamber 422. The scraper 496 can be formed integrally with the cover 427, or can be formed separately and attached within the cover 427 using any suitable joining method.

Optionally, the scraper 496 can be rigid, i.e. stiff and non-flexible, so the scraper 496 does not yield or flex by engagement with the brushroll 441. In one example, the scraper 496 can be formed of rigid thermoplastic material, such as poly(methyl methacrylate) (PMMA), polycarbonate, or acrylonitrile butadiene styrene (ABS). Alternatively, the scraper 496 can be pliant, i.e. flexible or resilient, in order to deflect according to the contour of the brushroll 441.

A squeegee 498 can be provided in the brush chamber 422, rearwardly of the brushroll 441, to wipe the surface to be cleaned while introducing liquid and dirt into the brush chamber 422 to reduce streaking on the surface to be cleaned, as well as to prevent dry dirt from scattering when the brushroll 441 is rotating during a dry mode of operation. The squeegee 498 can be disposed on the cover 427, behind the brushroll 441, and is configured to contact the surface as the robot 410 moves across the surface to be cleaned. Moisture or debris that contacts the squeegee 498 as the robot 410 moves forwardly is entrained in the air flow that goes through the suction conduit 489 and into the debris receptacle 444. The squeegee 498 can include nubs or ribs on a rearward-facing surface that facilitates liquid and debris passage under the squeegee 498 when the robot 410 is moving in a rearward direction. The opposite side, or forward-facing side, of the squeegee 498 can be a smooth surface that effectively moves surface moisture to trap it within the brush chamber 422 for entrainment in the air flow when the robot 410 is moving in a forward direction. The squeegee 498 can be pliant, i.e. flexible or resilient, in order to bend readily according to the contour of the surface to be cleaned, yet remain undeformed by typical operation of the robot 410. Optionally, the squeegee 498 can be formed of a resilient polymeric material, such as ethylene propylene diene monomer (EPDM) rubber, polyvinyl chloride (PVC), a rubber copolymer such as nitrile butadiene rubber, or any material known in the art of sufficient rigidity to remain substantially undeformed during a typical operation of the robot 410. It is noted that FIG. 22 shows the squeegee 498 unbent, whereas in operation, the squeegee 498 may be bent backward where it engages the floor surface when the robot 410 moves forward in the direction indicated by arrow 417.

Figure 23:
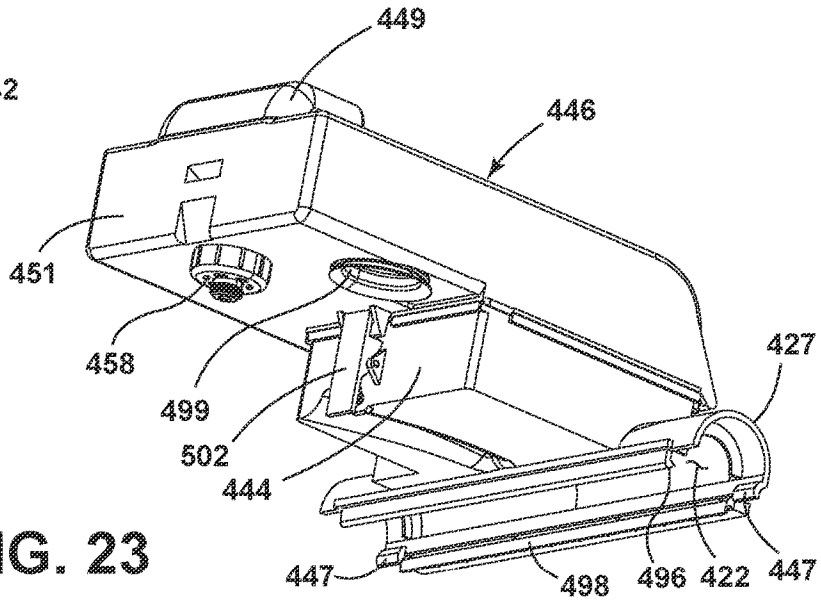
FIG. 23 is an isometric view of an underside of the tank assembly of the floor cleaning robot of FIG. 16.

Referring to FIGS. 20 and 23, when the tank assembly 446 is assembled or reassembled with the housing 412, one or more connections are made between components of the tank assembly 446 and components of the housing 412. For example, the supply tank 451 can be connected with the pump 453 and the debris receptacle 444 can be connected with the suction source 438.

The supply tank 451 can further include a valve 458 that is coupled with the valve receiver 437 on the housing 412. When the tank assembly 446 is seated on the housing 412, the valve 458 is opened by engagement with the valve receiver 437, and liquid can flow to the pump 453 via conduit 436. Alternatively, a direct connection can be made between the valve 458 and pump 453 upon seating of tank assembly 446 on the housing 412. In still another alternative, various other fluid connectors, conduits, ducts, or tubes can be provided to convey liquid from the supply tank 451 to an inlet of the pump 453.

The debris receptacle 444 can include an air outlet port 499 that is coupled with the air inlet port 439 of the suction source 438, or otherwise provided on the housing 12 and in fluid communication with the suction source 438, when the debris receptacle 444 is seated on the housing 412. The connection made between the air outlet port 499 and the inlet port 439 can be fluid-tight and can include appropriate sealing. Alternatively, various other fluid connectors, conduits, ducts, or tubes can be provided to convey working air from the debris receptacle 444 to an inlet of the suction source 438.

Figure 25:
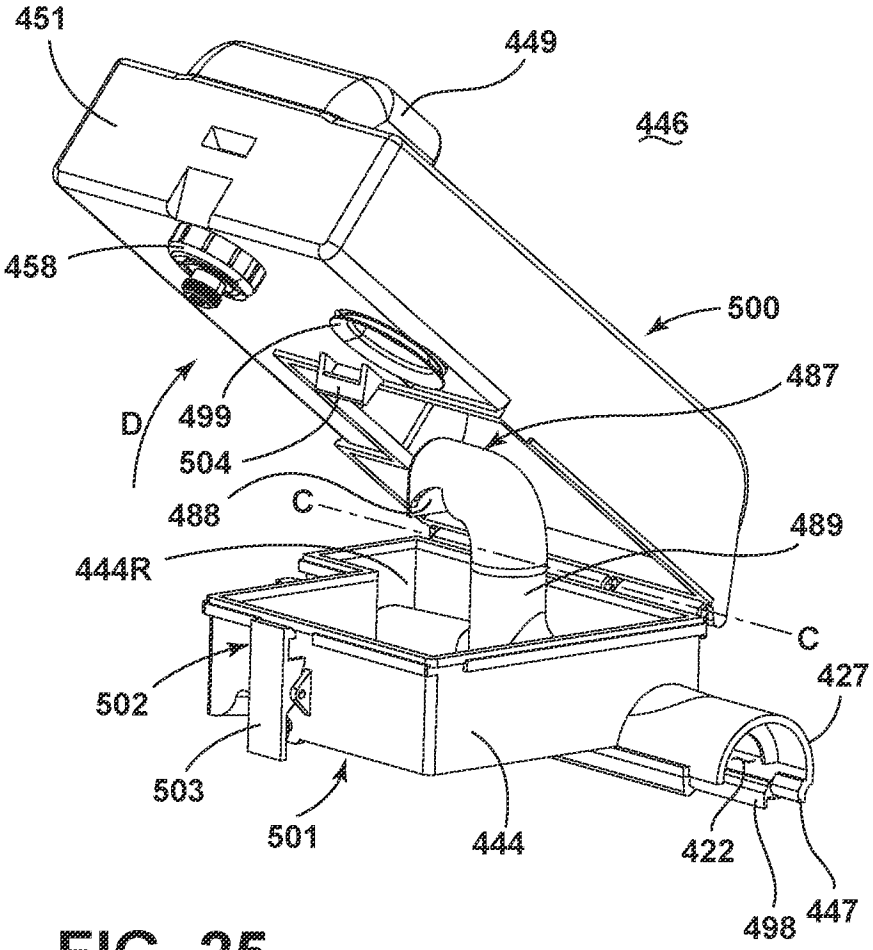
FIG. 25 is an isometric view of the tank assembly of FIG. 24.
Figure 24:
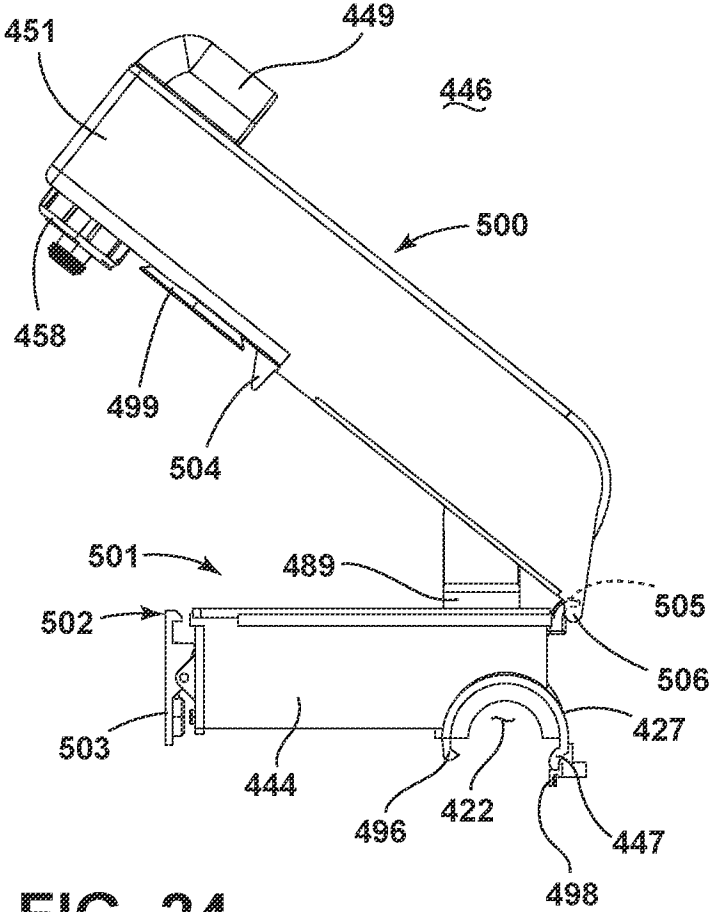
FIG. 24 is a side elevation view of the tank assembly of FIG. 23, showing a lid is a partially removed state.

Referring to FIGS. 24-25, to further aid the user in cleaning out the tank assembly 446, the tank assembly 446 can optionally include an openable and/or removable lid 500. The lid 500 can form a top or closure for the debris receptacle 444, and optionally can include the supply tank 451. The lid 500 can be secured to a lower portion 501 of the tank assembly 446. The lower portion 501 can include at least the debris receptacle 444, or at least the receptacle reservoir 444R of the debris receptacle 444. In the illustrated embodiment, the lower portion 501 further includes the cover 427, brush chamber 422, the suction conduit 489, and the separator 487. In some embodiments, the lid 500 can be openable while remaining attached to the debris receptacle 444 or lower portion 501, such as by pivoting away from the debris receptacle 444 or lower portion 501 to open the receptacle reservoir 444R. In other embodiments, the lid 500 can be openable by being fully removable from the debris receptacle 444 or lower portion 501.

A lid latch 502 can secure the lid 500 to a lower portion 501 of the tank assembly 446. The lid latch 502 includes a latch button 503 that is depressed by the user to release the lid 500 from the lower portion 501. The lid latch 502 can be any suitable latch, catch, or other mechanical fastener that can join the lid 500 and lower portion 501, while allowing for the regular separation of the lid 500 from the lower portion 501, such as a spring-biased latch operable via the latch button 503. A latch receiver 504 can be provided on the lid 500 to accept the lid latch 502 and secure the lid 500 to the lower portion 501.

Further, the tank assembly 446 can include pivot coupling for movement of the lid 500 about axis C, shown herein as a hook-and-catch mechanism that allows the lid 500 to be fully separated from the lower portion 501. The hook-and-catch mechanism shown includes a hook 505 on the lower portion 501 that engages with a catch 506 on the lid 500. Multiple hooks 505 and catches 506 can be provided. Alternatively, the hooks 505 can be provided on the lid 500 and the catches 506 can be provided on the lower portion 501. In yet another embodiment, the tank assembly 446 can be pivotally mounted to the lower portion 501 about axis C for rotation of the lid 500 between open and closed positions, without full separation of the lid 500 from the lower portion 501.

The lid 500 is shown in a partially-removed state from the lower portion 501 in FIGS. 24-25. The lid 500 can be removed by pressing the latch button 503 and rotating the lid 500 away from the lower portion 501 about axis C as indicated by arrow D. Once the hooks 505 have cleared the catches 506, the lid 500 can be separated from the lower portion 501. After removing the lid 500, the recovered liquid and dirt can be poured out of the debris receptacle 444. The entire lower portion 501, including the internal surface of the debris receptacle 444 and the internal surface of the brush chamber 422 can then be rinsed.

As shown in FIG. 25, in one embodiment, the separator 487 can be a conduit or duct having a bend for redirecting the working airstream with entrained liquid and/or debris approximately 90 degrees to travel though a separator outlet opening 488 and into the debris receptacle 444. The liquid and/or debris will strike the various walls of the separator 487 and fall downwardly into the receptacle reservoir 444R. Other degrees of bend for the separator 487 are possible, such as 90-180 degrees. The liquid and debris collect in the receptacle reservoir 444R, while the working airstream passes through the air outlet port 499 and to the suction source 438. The separator 487 can be oriented such that the airflow entering the debris receptacle 444 through the separator outlet opening 488 is positioned away from the air outlet port 499.

Figure 26:
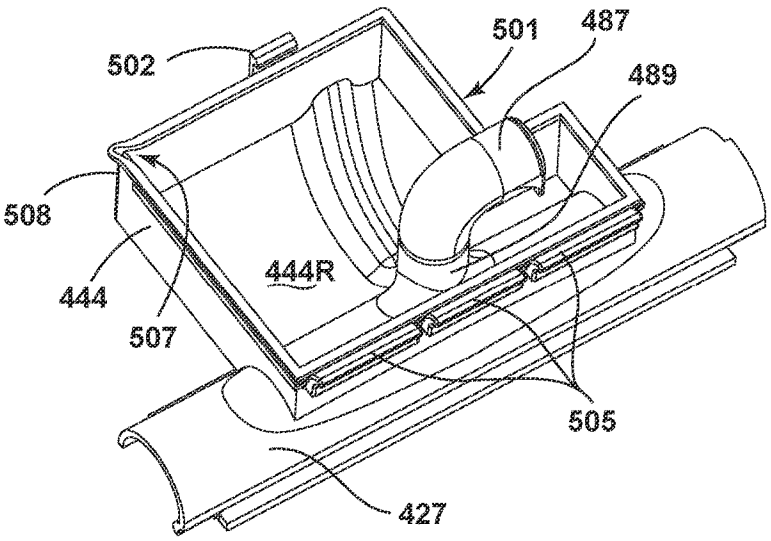
FIG. 26 is an isometric view of a lower portion of the tank assembly of FIG. 24, with the lid removed.

FIG. 26 shows an alternate embodiment of the lower portion 501 of the tank assembly 446, with the lid 500 removed. In some embodiments, the debris receptacle 444 can have a pour spout 507 to aid in conveying liquid and debris out of the receptacle reservoir 444R. The pour spout 507 can help show the user how to angle the debris receptacle 444 to optimally empty the debris receptacle 444. The pour spout 507 can be provided at a corner 508 of the debris receptacle 444 disposed away from the brush chamber 422. Optionally, the pour spout 507 can be covered by the lid 501 (FIG. 25) when the lid 501 is closed and can be exposed to view when the lid 501 is open.

Figure 27:
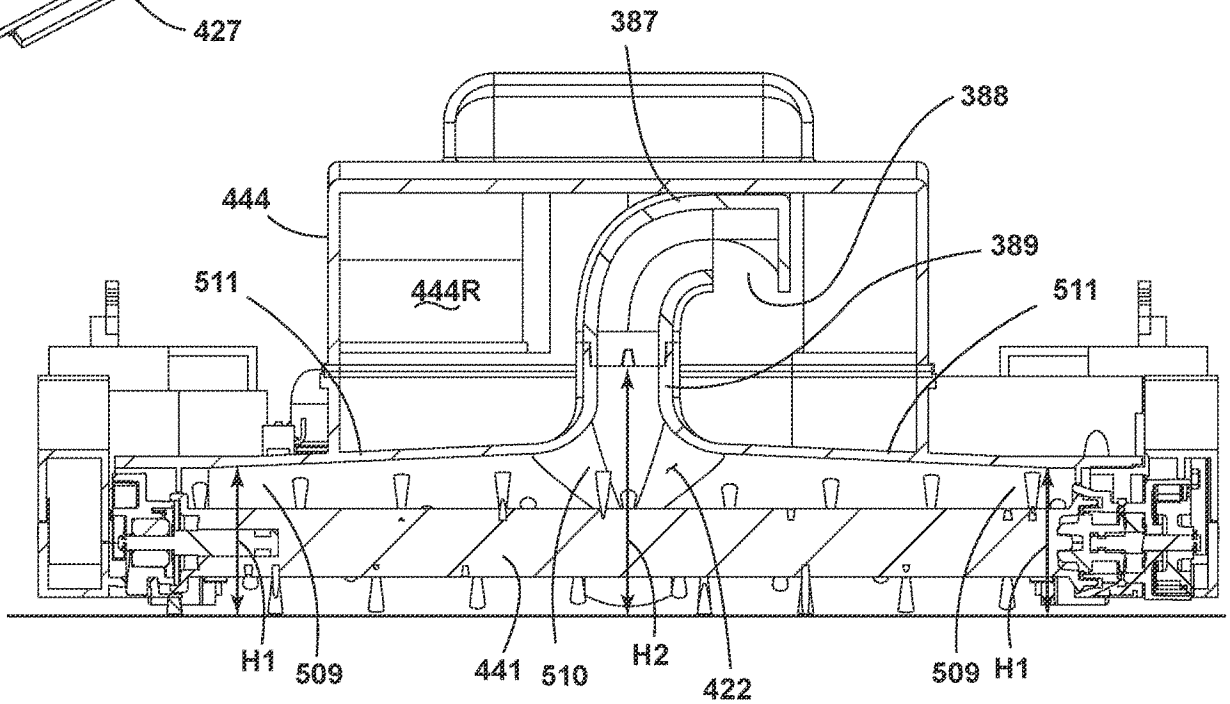
FIG. 27 is a cross-sectional view taken through line XVII-XVII of FIG. 17.

Referring to FIG. 27, as described above, the suction conduit 489 pulls debris and excess liquid from the brushroll 441. The brush chamber 422 helps define the air flow that goes through the suction conduit 489 and into the debris receptacle 444. In the illustrated embodiment, the brush chamber 422 includes lateral ends 509, with the suction conduit 489 in fluid communication with a portion of the brush chamber 422 between the lateral ends 509. The suction conduit 489 can in particular fluidly communicate with a middle portion 510 of the brush chamber 422 centered between the lateral ends 509, such that each lateral end 509 is substantially equidistant from the suction conduit 489, or can be otherwise located relative to the lateral ends 509.

The brush chamber 422 can taper to become smaller (e.g. shorter) at the lateral ends 509. The taper helps develop air flow across the entire length of the brushroll 441 and improves recovery. At least an inner surface of an upper wall 511 of the brush chamber 422 can be tapered toward the lateral ends 509. The upper wall 511 can be smoothly angled toward the suction conduit 489 to substantially continuously increase the height of the brush chamber 422 toward the suction conduit 489. In the illustrated embodiment, the brush chamber 422 has a height H1 at one or both of the lateral ends 509 and a height H2 at the suction conduit 489 which is greater than the height H1. With the suction conduit 489 in fluid communication with the middle portion 510 of the brush chamber 422 centered between the lateral ends 509 as shown herein, the height H2 can be measured at the middle portion 510 of the brush chamber 422 centered between the lateral ends 509.

In an alternative embodiment of the robot 410 shown in FIGS. 16-27, the tank assembly 446 can combine the debris receptacle 444 and the brush chamber 422 in one unitary assembly or module. The supply tank 451 can be separate from the tank assembly 446 such that it is removable from the housing 412 separately from the tank assembly 446. The supply tank 451 can be configured such that it is removable from the housing 412 before or after the tank assembly 446. Alternatively, the supply tank 451 and the tank assembly 446 can have an interlocking mounting arrangement such that the supply tank 451 must be removed prior to removal of the tank assembly 446, or vice versa.

Figure 28:
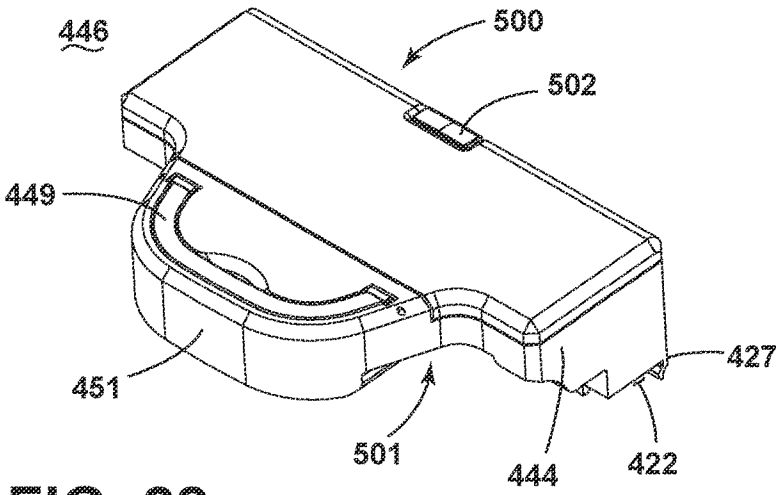
FIG. 28 is an isometric view of another tank assembly that can be utilized in the floor cleaning robot of FIG. 16.
Figure 29:
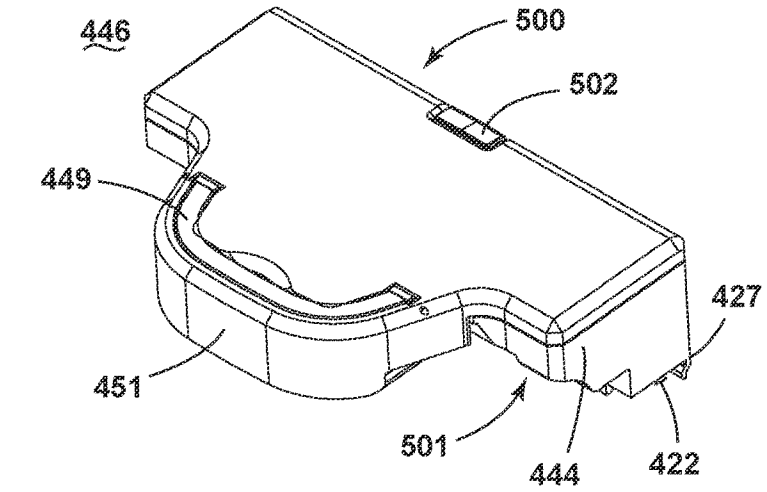
FIG. 29 is an isometric view of another tank assembly that can be utilized in the floor cleaning robot of FIG. 16.
Figure 30:
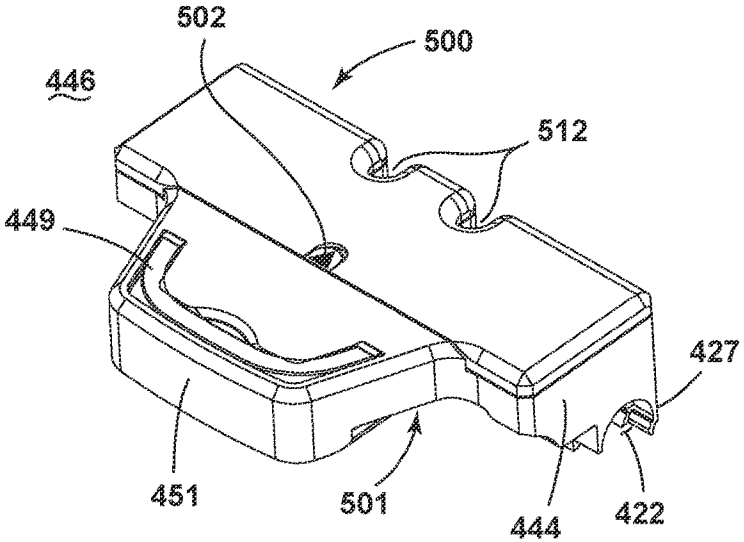
FIG. 30 is an isometric view of another tank assembly that can be utilized in the floor cleaning robot of FIG. 16.

Several alternative embodiments of tank assemblies 446 for the robot 410 are shown in FIGS. 28-30. The tank assemblies 446 are similar to the tank assembly 446 described above with reference to FIGS. 16-27, therefore like parts will be identified with like reference numerals, with it being understood that the description of the like parts of the tank assembly 446 and robot 410 applies to the tank assemblies 446 shown in FIGS. 28-30, except where noted.

Referring to FIG. 28, the illustrated tank assembly 446 differs by including a fully removable lid 500 that is separate from the supply tank 451. The lower portion 501 can therefore include the supply tank 451, in addition to the debris receptacle 444, cover 427, and brush chamber 422. Another difference is that the lid latch 502 securing the lid 500 to the lower portion 501 of the tank assembly 446 is accessible from the top rear side of the tank assembly 446, and the lid 500 can lift off the lower portion 510 without pivoting.

Another difference is that the tank assembly 446 includes a pivoting handle 449 and The handle 449 can pivot against the tank assembly 446 to lie substantially flush with the upper surface of the tank assembly 446 and pivot away upwardly away from the upper surface of the tank assembly 446 for a user to grasp. The pivoting handle 449 can be provided on top of the supply tank 451, separate from the lid 500.

Referring to FIG. 29, the illustrated tank assembly 446 differs from the tank assembly 446 shown in FIG. 28 by having the supply tank 451 integral with the lid 500 and the pivoting handle 449 on the lid 500.

Referring to FIG. 30, the illustrated tank assembly 446 differs from the tank assembly 446 shown in FIG. 28 by having the lid latch 502 accessible from the top of the tank assembly 446, at a forward side of the debris receptacle 444, and by providing finger indentations 512 at a rear side of the debris receptacle 444. The consumer can grip the handle 449 in one hand and, using their other hand, simultaneously operate the lid latch 502 with their thumb while lifting the lid 500 away from the lower portion 501 to separate the lid 500 from the lower portion 501.

There are several advantages of the present disclosure arising from the various aspects or features of the apparatus, systems, and methods described herein. For example, aspects described above provide an autonomous cleaning robot that sweeps and mops a floor surface in a single pass, including a single pass in a "forward" or "backward" direction. The present disclosure provides a single autonomous floor cleaner that sweeps directly in front of the dusting assembly. This eliminates the need for either two floor cleaning apparatus to completely clean or a single robot that cleans by multiple passes.

Another advantage of aspects of the disclosure relates to the consistency and robustness of the liquid distribution system. In contrast to prior art wicking pads, the disclosed pump and spray nozzle provide fluid at a consistent low flowrate that does not degrade over time. The low flowrate of the applied liquid results in a clean floor surface that is substantially dry after contact with the rotating pads of the dusting assembly concludes. The use of a pulse-width modulation signal as described herein can further provide for custom-tailoring of a fluid delivery rate for a variety of floor surfaces, including the adjustment of fluid dwelling times.

Yet another advantage of aspects of the disclosure relates to the configuration of the brushroll of the sweeper, the wheels of the drive mechanism and the spinning pads of the dusting assembly. By aligning the outer edges of the wheels, the brushroll and the spinning pads as shown and described above, entrainment of debris in the wheels and spinning pads is reduced thereby improving the driving and cleaning performance of the floor cleaning robot.

Still another advantage of aspects of the disclosure relate to the use of a pulse-width modulated signal to drive operation of one or more components such as the fluid pump. Such a modulated signal provides for a reduction in circuit complexity for driving the pump at a variety of flowrates, including at low flow rates, without use of a variable resistor (which can generate undesirable amounts of heat) or use of other, more complex methods of reducing the voltage provided to the pump by the battery pack.

Another advantage of aspects of the disclosure relate to the ease of access to one or more tanks within the autonomous floor cleaner, including the unitary or integrated tank assembly being selectively removable from the robot housing. Removal of a single unit can improve the ease of refilling the supply tank or cleaning out the debris receptacle without need of manipulating the entire robot for a cleanout or refill operation.

Another advantage of aspects of the disclosure relate to a floor cleaning apparatus including a housing moveable over a surface to be cleaned, a supply tank configured to store a supply of cleaning fluid, and a unitary assembly removably mounted to the housing, wherein the unitary assembly is configured to be selectively detached from the moveable housing, the unitary assembly having a brush chamber, a brushroll located in the brush chamber, at least one fluid distributor, and a debris receptacle fluidly coupled to the brush chamber. The at least one fluid distributor can be in fluid communication with the supply tank and a fluid delivery pump can be provided to control a flow of cleaning fluid from the supply tank to the at least one fluid distributor.

Yet another advantage of aspects of the disclosure relates to the configuration of the latch, handle, and pivot coupling for the unitary or integrated tank assembly. In some embodiments disclosed herein, the user provides opposing forces to actuate the latch and lift the tank assembly upwardly away the housing. This helps create a clean breakaway between the two assemblies and keeps the housing in position during removal of the tank assembly.

Still another advantage of aspects of the disclosure relate to the configuration of the brush chamber and suction conduit leading to the debris receptacle. In some embodiments disclosed herein, the brush chamber tapers to become smaller in a direction away from the suction conduit, which can help develop air flow across the entire length of the brushroll and improve recovery.

While various embodiments illustrated herein show an autonomous floor cleaner or floor cleaning robot, aspects of the invention may be used on other types of surface cleaning apparatus and floor care devices, including, but not limited to, an upright extraction device (e.g., a deep cleaner or carpet cleaner) having a base and an upright body for directing the base across the surface to be cleaned, a canister extraction device having a cleaning implement connected to a wheeled base by a vacuum hose, a portable extraction device adapted to be hand carried by a user for cleaning relatively small areas, or a commercial extractor. Still further, aspects of the invention may also be used on surface cleaning apparatus which include a fluid recovery system and not a fluid supply system, or on surface cleaning apparatus which include a fluid supply system and not a fluid recovery system. Still further, aspects of the invention may also be used on surface cleaning apparatus other than extraction cleaners, such as a steam cleaner or a vacuum cleaner. A steam cleaner generates steam by heating water to boiling for delivery to the surface to be cleaned, either directly or via cleaning pad. Some steam cleaners collect liquid in the pad, or may extract liquid using suction force. A vacuum cleaner typically does not deliver or extract liquid, but rather is used for collecting relatively dry debris (which may include dirt, dust, stains, soil, hair, and other debris) from a surface.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A floor cleaning robot, comprising:

an autonomously moveable housing;

a drive system for autonomously moving the autonomously moveable housing over a surface to be cleaned based on inputs from a controller;

a unitary assembly removably mounted to the autonomously moveable housing, wherein the unitary assembly is configured to be selectively detached from the autonomously moveable housing, the unitary assembly comprising:

a brush chamber; and a debris receptacle fluidly coupled to the brush chamber;

a brushroll located in the brush chamber;

a supply tank configured to store a supply of cleaning fluid;

at least one fluid distributor in fluid communication with the supply tank and configured to dispense cleaning fluid; and a fluid delivery pump configured to control a flow of cleaning fluid from the supply tank to the at least one fluid distributor.

2. The floor cleaning robot of claim 1, wherein the brush chamber is pivotally coupled with the autonomously moveable housing by a pivotal coupling, and the unitary assembly is configured to be selectively detached from the autonomously moveable housing by rotating the unitary assembly about a pivot axis defined by the pivotal coupling, and then lifting the unitary assembly to decouple the brush chamber from the autonomously moveable housing.

3. The floor cleaning robot of claim 2, wherein the pivotal coupling comprises:

a catch on one of the unitary assembly and the autonomously moveable housing; and a hook on the other of the unitary assembly and the autonomously moveable housing, the hook configured to engage the catch to pivotally couple the unitary assembly to the autonomously moveable housing.

4. The floor cleaning robot of claim 2, further comprising a latch securing the unitary assembly to the autonomously moveable housing, wherein the unitary assembly is configured to be selectively detached from the autonomously moveable housing by actuating the latch, rotating the unitary assembly about a pivot axis defined by the pivotal coupling, and then lifting the unitary assembly to decouple the brush chamber from the autonomously moveable housing.

5. The floor cleaning robot of claim 1, further comprising a latch securing the unitary assembly to the autonomously moveable housing.

6. The floor cleaning robot of claim 5, wherein the latch comprises a latch actuator provided on the autonomously moveable housing, wherein the unitary assembly is configured to be selectively detached from the autonomously moveable housing by pressing downwardly on the latch actuator and then lifting the unitary assembly upwardly.

7. The floor cleaning robot of claim 5, wherein the unitary assembly comprises a handle proximate to the latch so that a user can grip the handle to lift the unitary assembly upwardly and actuate the latch with one hand.

8. The floor cleaning robot of claim 1, wherein the brush chamber is defined by a cover that extends over the autonomously moveable housing so that the autonomously moveable housing is not exposed to the brushroll.

9. The floor cleaning robot of claim 1, further comprising a suction conduit extending from the brush chamber to fluidly communicate with the debris receptacle and a suction source in fluid communication with the suction conduit for generating a working airstream through the debris receptacle.

10. The floor cleaning robot of claim 9, wherein the brush chamber includes lateral ends, a middle portion between the lateral ends, the suction conduit joins the brush chamber at the middle portion, and the brush chamber tapers to become smaller at the lateral ends.

11. The floor cleaning robot of claim 9, further comprising a scraper configured to remove liquid and debris from the brushroll, wherein the scraper is provided within the brush chamber and engages the brushroll.

12. The floor cleaning robot of claim 9, wherein the debris receptacle includes a separator configured to separate liquid and debris from the working airstream, and wherein the suction conduit and the separator form portions of the unitary assembly, wherein the suction source comprises a vacuum motor carried on the autonomously moveable housing, the vacuum motor having a motor air inlet port, and the debris receptacle comprises an air outlet port that is coupled with the motor air inlet port when the unitary assembly is mounted to the autonomously moveable housing to fluidly couple the debris receptacle with the suction source.

13. The floor cleaning robot of claim 9, wherein the autonomously moveable housing comprises an air inlet port in fluid communication with the suction source and the debris receptacle comprises an air outlet port that is coupled with the air inlet port when the unitary assembly is mounted to the autonomously moveable housing to fluidly couple the debris receptacle with the suction source.

14. The floor cleaning robot of claim 1, wherein the unitary assembly comprises an openable lid selectively secured to a lower portion of the unitary assembly and moveable between a closed position and an open position, the lower portion including at least a receptacle reservoir of the debris receptacle.

15. The floor cleaning robot of claim 14, wherein the openable lid is fully separable from the lower portion.

16. A floor cleaning robot, comprising:

an autonomously moveable housing;

a drive system for autonomously moving the autonomously moveable housing over a surface to be cleaned based on inputs from a controller;

a unitary assembly removably mounted to the autonomously moveable housing, wherein the unitary assembly is configured to be selectively detached from the autonomously moveable housing, the unitary assembly comprising:

a brush chamber; and a debris receptacle fluidly coupled to the brush chamber;

a brushroll located in the brush chamber;

a supply tank configured to store a supply of cleaning fluid; and at least one fluid distributor in fluid communication with the supply tank and configured to dispense cleaning fluid.

17. The floor cleaning robot of claim 16, wherein the brush chamber is defined by a cover that extends over the autonomously moveable housing so that the autonomously moveable housing is not exposed to the brushroll.

18. The floor cleaning robot of claim 16, further comprising a suction conduit extending from the brush chamber to fluidly communicate with the debris receptacle and a suction source in fluid communication with the suction conduit for generating a working airstream through the debris receptacle.

19. The floor cleaning robot of claim 18, wherein the debris receptacle includes a separator configured to separate liquid and debris from the working airstream, and wherein the suction conduit and the separator form portions of the unitary assembly, wherein the suction source comprises a vacuum motor carried on the autonomously moveable housing, the vacuum motor having a motor air inlet port, and the debris receptacle comprises an air outlet port that is coupled with the motor air inlet port when the unitary assembly is mounted to the autonomously moveable housing to fluidly couple the debris receptacle with the suction source.

20. The floor cleaning robot of claim 18, wherein the autonomously moveable housing comprises an air inlet port in fluid communication with the suction source and the debris receptacle comprises an air outlet port that is coupled with the air inlet port when the unitary assembly is mounted to the autonomously moveable housing to fluidly couple the debris receptacle with the suction source.

* * * * *